United States Patent [19]

Katou

[11] Patent Number: 5,001,960

[45] Date of Patent: Mar. 26, 1991

[54] APPARATUS FOR CONTROLLING REPRODUCTION ON PITCH VARIATION OF AN INPUT WAVEFORM SIGNAL

[75] Inventor: Hitoshi Katou, Fussa, Japan

[73] Assignee: Casio Computer Co., Ltd., Tokyo, Japan

[21] Appl. No.: 362,830

[22] Filed: Jun. 7, 1989

[30] Foreign Application Priority Data

| | | | |
|---|---|---|---|
| Jun. 10, 1988 | [JP] | Japan | 63-143376 |
| Jun. 10, 1988 | [JP] | Japan | 63-143377 |
| Jun. 10, 1988 | [JP] | Japan | 63-143378 |
| Jun. 10, 1988 | [JP] | Japan | 63-143379 |

[51] Int. Cl.[5] ..... G10H 1/053; G10H 1/06; G10H 1/18

[52] U.S. Cl. ..... 84/735; 84/739; 84/740; 84/741; 84/742

[58] Field of Search ..... 84/616, 622–633, 84/654, 659–665, 681, 692–711, 454, DIG. 18, 735–742

[56] References Cited

U.S. PATENT DOCUMENTS

| | | | |
|---|---|---|---|
| 4,117,757 | 10/1978 | Akamatu . | |
| 4,280,387 | 7/1981 | Moog | 84/654 X |
| 4,606,255 | 8/1986 | Hayashi et al. . | |
| 4,627,323 | 12/1986 | Gold | 84/654 X |
| 4,633,748 | 1/1987 | Takashima et al. . | |
| 4,688,464 | 8/1987 | Gibson et al. . | |

FOREIGN PATENT DOCUMENTS

| | | |
|---|---|---|
| 55-55398 | 4/1980 | Japan . |
| 55-87196 | 7/1980 | Japan . |
| 55-152597 | 11/1980 | Japan . |
| 55-162132 | 11/1980 | Japan . |
| 55-159495 | 12/1980 | Japan . |
| 57-37074 | 8/1982 | Japan . |
| 57-58672 | 12/1982 | Japan . |
| 61-26090 | 2/1986 | Japan . |
| 61-51793 | 11/1986 | Japan . |
| 62-20871 | 5/1987 | Japan . |
| 62-163099 | 7/1987 | Japan . |

*Primary Examiner*—Stanley J. Witkowski

*Attorney, Agent, or Firm*—Frishauf, Holtz, Goodman & Woodward

[57] ABSTRACT

An input waveform signal representing, for example, a string oscillation is input to a pitch extraction circuit. The pitch extraction circuit extracts a pitch frequency from the input waveform signal, and this pitch frequency is input to a RAM connected to a CPU. On the other hand, LFO data from an LFO is input to a RAM. The CPU detects the amount of variation of the pitch frequency based on the pitch frequency and coverts the amount of variation of the pitch frequency in accordance with a predetermined conversion function. Thereafter the converted value is added to the LFO data to form musical sound control data for imparting a tremolo effect or a vibrato effect. The musical sound production circuit thereby imparts the above effect to the musical sound to be produced.

24 Claims, 21 Drawing Sheets

PITCH FREQUENCY DATA Aj,Bj

LFO DATA Lj

FREQUENCY VARIATION AMOUNT DATA Cj

EFFECT DATA Ej

MUSICAL SOUND CONTROL DATA Gj

PITCH FREQUENCY DATA Aj,Bj
INITIAL VALUE UPON NOTE-ON
Bj
Aj
FON
0
t

FREQUENCY VARIATION AMOUNT DATA Cj

EFFECT DATA Ej
INITIAL VALUE UPON NOTE-ON

LFO DATA Lj
INITIAL VALUE UPON NOTE-ON
T TIMER INTERRUPT PERIOD

MUSICAL SOUND CONTROL DATA Gj
INITIAL VALUE UPON NOTE-ON
△ --- TIMER INTERRUPT ROUTINE
●,○ --- PITCH VARIATION PROCESS ROUTINE

PITCH FREQUENCY DATA Aj,Bj
Bj
FON
INITIAL VALUE UPON NOTE-ON = Aj
0
t

FREQUENCY VARIATION AMOUNT DATA Cj

EFFECT DATA Ej
INITIAL VALUE UPON NOTE-ON

LFO DATA Lj
INITIAL VALUE UPON NOTE-ON
T TIMER INTERRUPT PERIOD

MUSICAL SOUND CONTROL DATA Gj
INITIAL VALUE UPON NOTE-ON
△ --- TIMER INTERRUPT ROUTINE
●,○ --- PITCH VARIATION PROCESS ROUTINE

PITCH FREQUENCY DATA Aj,Bj
B POINT
FON
INITIAL VALUE UPON NOTE-ON
A POINT

FREQUENCY VARIATION AMOUNT DATA Cj
A POINT
B POINT

EFFECT DATA Ej
INITIAL VALUE UPON NOTE-ON

LFO DATA Lj
INITIAL VALUE UPON NOTE-ON
T TIMER INTERRUPT PERIOD

MUSICAL SOUND CONTROL DATA Gj
INITIAL VALUE UPON NOTE-ON
△ ---- TIMER INTERRUPT ROUTINE
●,○ --- PITCH VARIATION PROCESS ROUTINE

PITCH FREQUENCY DATA Aj,Bj
FON
INITIAL VALUE UPON NOTE-ON = Aj

FREQUENCY VARIATION AMOUNT DATA Cj
C POINT

EFFECT DATA Ej
INITIAL VALUE UPON NOTE-ON

LFO DATA Lj
T TIMER INTERRUPT PERIOD
INITIAL VALUE UPON NOTE-ON

MUSICAL SOUND CONTROL DATA Gj
INITIAL VALUE UPON NOTE-ON
Δ ----- TIMER INTERRUPT ROUTINE
●,O----- PITCH VARIATION PROCESS ROUTINE

APPARATUS FOR CONTROLLING REPRODUCTION ON PITCH VARIATION OF AN INPUT WAVEFORM SIGNAL

BACKGROUND OF THE INVENTION

1. Field of the Invention

The present invention relates to an electronic musical instrument which produces a musical sound with a pitch corresponding to pitch data detected from an input waveform signal, and more particularly to a control apparatus for use in a musical sound production apparatus for controlling a musical sound according to pitch variation information detected from the pitch data.

2. Description of the Prior Art

A type of electronic musical instrument has been developed which detects an oscillation of an activated string of a guitar or the like as an electronic waveform signal, and controls a digital or analog musical sound producing circuit in accordance with the input waveform signal to synthesize a musical sound and produce a sound. On the other hand, the input waveform signal may be formed by electrically detecting an acoustic signal produced by a human voice or an acoustic musical instrument.

The following articles disclose these technologies.

U.S. Pat. No. 4,117,757 (issued on Oct. 3, 1978), inventor: Akamatsu.

This article discloses an electronic circuit which produces a waveform signal whose logical value sequentially reverses between "1" and "0" at positive and negative peak points of the input waveform signal. The waveform signal becomes a rectangular wave signal and its frequency corresponds to the pitch of the input waveform signal.

U.S. Pat. No. 4,606,255 (issued on Aug. 19, 1986), inventor: Hayashi et al.

This article discloses a guitar synthesizer. The apparatus extracts a pitch from every string and thereby provides a corresponding voltage signal and produces a musical signal based on the voltage signal.

U.S. Pat. No. 4,633,748 (issued on Jan. 6, 1987), inventor: Takashima et al.

This article discloses a technology for extracting a pitch through a digital process after converting an acoustic signal input from a microphone into a digital signal.

U.S. Pat. No. 4,688,464 (issued on Aug. 25, 1987), inventor: Gibson et al.

This article discloses a technology for extracting a pitch in accordance with a time interval which is obtained by the input waveform signal crossing three threshold levels comprising a high threshold level, a middle threshold level and/or a low threshold level.

Japanese Patent Publication No 57-37074 (published on Aug. 7, 1982), applicant: Roland Kabushiki Kaisha.

Japanese Patent Publication No. 57-58672 (published on Dec. 10, 1982), applicant Roland Kabushiki Kaisha.

These two articles correspond to the above U.S. Pat. No. 4,117,757 and both disclose a technology for producing a rectangular wave with a frequency corresponding to a pitch of the input waveform signal.

Japanese Patent Disclosure (Kokai) No. 55-55398 (disclosed on Apr. 23, 1980) applicant: Toshiba Corp.

This article, as in the above U.S. Pat. No. 4,117,757, discloses a technology for producing a rectangular wave with a frequency corresponding to a pitch of the input waveform signal.

Japanese Patent Disclosure (Kokai) No. 55-87196 (disclosed on July 1, 1980), applicant: Nippon Gakki Seizo Kabushiki Kaisha.

This article discloses a technology for producing a basic wave pulse with a period corresponding to a pitch in accordance with the output of the guitar pick-up, and providing frequency information by counting with an interval counter, and converting the frequency information into digital frequency information.

Japanese Patent Disclosure (Kokai) No. 55-159495 (disclosed on Dec. 11, 1980), applicant: Nippon Gakki Seizo Kabushiki Kaisha.

This article disclosed the art which outputs a coincidence signal when adjoining periods extracted from an input waveform signal are almost coincident, thereby resulting in no change in extracted pitch, and indicates a start of sound production in accordance with the coincidence signal.

Japanese Utility Model Disclosure (Kokai) No. 55-152597 (disclosed on Nov. 4, 1980) applicant: Nippon Gakki Seizo Kabushiki Kaisha.

This article discloses a technology for extracting an oscillation of a string using an optical pick-up, causing an oscillation of a string by using a pick-up signal to provide a maintaining effect of an oscillation.

Japanese Utility Model Disclosure (Kokai) No. 55-162132 (disclosed on Nov. 20, 1980), applicant; Keio Giken Kogyo Kabushiki Kaisha.

This article discloses a technology for detecting zero cross points following positive and negative peak points of the input waveform signal to produce a frequency signal corresponding to a pitch with a flip-flop, which is set or reset every time the zero cross point occurs.

Japanese Patent Publication No. 61-51793 (published on Nov. 10, 1982), applicant: Nippon Gakki Seizo Kabushiki Kaisha.

This article is a patent publication corresponding to the Japanese Patent Disclosure (Kokai) No. 55-87196 and the subject matter thereof is the same as the content of the Japanese Patent Disclosure (Kokai) No. 55-159495. Namely, the present article discloses a technology for producing digital frequency information by detecting substantial concidence of adjacent periods extracted from the input waveform signal.

Japanese Utility Model Disclosure (Kokai) No. 62-20871 (published on May. 27, 1987), applicant: Fuji Roland Kabushiki Kaisha.

This is the Japanese Utility Model Publication corresponding to the above U.S. Pat. No. 4,606,255.

Japanese Utility Model Disclosure (Kokai) No. 61-26090 (disclosed on Feb. 5, 1986), applicant: Seikou Denshi Kogyo Kabushiki Kaisha.

This article discloses a technology for obtaining exact pitch information by detecting a pitch from the input waveform signal and sequentially writing it into a memory and thereafter obtaining accurate pitch data through an arithmetic operation.

Japanese Patent Disclosure (Kokai) No. 62-163099 (disclosed on July 18, 1987), applicant: Fuji GenGakki Seizo Kabushiki Kaisha.

This article discloses a technology relating to a guitar controller for use in a synthesizer. This is a technology for switching a method of changing a frequency, depending on whether the sound to be performed is a single sound or plural sounds. For a single sound, a picked-up oscillation period is caused to be reflected onto a musical sound to be continuously produced as it is, and for plural sounds the picked-up frequency period is caused to be reflected chromatically onto a musical sound in chromatic scale steps.

Further, the U.S. patent applications which are assigned to the present assignee and relate to an electronic string musical instrument or a related electronical apparatus are as follows.

U.S. Ser. No. 112,780 (filed on Oct. 22, 1987), inventor Uchiyama et al.

This article discloses a technology for measuring a time period between positive and negative peak points, or a time period between zero cross points related to the peak points, and extracting the peak based on the measured time period, and performing various controls in accordance with the extracted peak.

U.S. Ser. No. 184,099 (filed on Apr. 20, 1988), inventor: Iba et al.

This article discloses a technology for designating a parameter of a musical sound such as a timbre by operating a fret and picking a string. This technology extracts a pitch and detects the operated fret by a fret switch.

U.S. Ser. No. 256,398 (filed on Oct. 7, 1988), inventor: Iba et al.

This article discloses a technology for controlling a musical sound production with regard to respective strings, varying a characteristic of the output musical sound according to the strength at which a string is picked, or actuating an effector or pan (localization in sound filed).

U.S. Ser. No. 252,914 (filed on Oct. 3, 1988), Inventor: Uchiyama.

This article discloses a technology for changing a pitch extraction circuit from a conventional analog circuit to a digital circuit, to facilitate integration of the circuit.

U.S. Ser. No. 256,400 (filed on Oct. 11, 1988), Inventor: Matsumoto.

This article relates to an electronic apparatus for extracting a pitch from an input waveform signal and for producing a musical sound having that pitch, and discloses a technology for changing a pitch of an output sound in accordance of a variation of the pitch of the input waveform signal and for deleting an unnecessary variation of an interval.

U.S. Ser. No. 282,510 (filed on Dec. 9, 1988), Inventor: Obata.

This article discloses a technology for starting a musical sound production whose interval is accurate and stable and for instructing start of a musical sound production in a chromatic manner, based on a pitch extracted from a pitch extraction means.

U.S. Ser. No. 290,981 (filed on Dec 28, 1988), Inventor: Murata et al.

This article discloses a technology for electronically performing a perfect tuning of a string. Namely, it discloses a technology for determining a reference pitch by pressing a string onto a predetermined fret and picking the string before a performance and, based on a reference pitch, determining the pitch of the produced musical sound from period information obtained by the picking at the designated fret.

U.S. Ser. No. 329,418 (filed on Mar. 27, 1989), Inventor: Obata.

This article discloses a technology for detecting a signal strength at a point of a rising of an input waveform signal and a degree of variation of the signal strength and for enabling a volume of a musical sound or timbre to be controlled independently by those two parameters. This technology makes it possible to vary only the timbre without changing the volume of the musical sound, for example, by shifting the position at which the string of an electronic string musical instrument is picked.

Where an electronic musical instrument is realized by using the above recited prior art, a pitch frequency is extracted from an input waveform signal and a musical sound production circuit produces a musical sound having pitch corresponding to the pitch frequency. However, if such a musical instrument can be realized as, for example, an electronic guitar, the following problems are observed.

Where a performer intentionally changes the pitch frequency of an input waveform signal by a choking method or by a tremolo arm operation, the performer can change the pitch of the produced musical sound in accordance with a variation in pitch, but cannot change the timbre or volume of the musical instrument. Therefore, there is a problem that a variety of musical expression cannot be achieved.

SUMMARY OF THE INVENTION

The present invention is provided based on the above background and is aimed at realizing a richer expression of a performance by controlling the characteristics of timbre, volume and pitch of the musical sound from a variation in pitch frequency.

Another object of the present invention is to quickly respond to a rapid change in pitch frequency performed by the performer and to control a rapid change in respective parameters of the musical sound.

A further object of the present invention is to obtain a change in musical sound desired by a performer using any performing method where the musical sound can be controlled in accordance with a variation in pitch.

A still further object of the present invention is to realize more natural and richer expression by adding an amplitude of a velocity of an input waveform signal to a control of the musical sound corresponding to a change in pitch.

The present invention provides a control apparatus for use in a musical sound production apparatus for controlling characteristics of a musical sound to be produced by a musical sound production apparatus based on an input waveform signal, comprising:

a pitch extraction means for extracting pitch data from an input wave form signal, a pitch variation detecting means coupled to said pitch extraction means for detecting a variation of said pitch data to obtain pitch variation data; and a control means coupled to said pitch variation detecting means for variably controlling characteristics of the musical sound to be produced by the musical sound production apparatus based on the pitch variation data.

Specifically, the present invention provides a control apparatus for a musical sound production apparatus for controlling a characteristic of a musical sound from the musical sound production apparatus which is realized, for example, as an electronic guitar.

The electronic guitar, taken as an example, detects a string oscillation waveform signal, produced by a picking of a string by a performer, from a pick-up means, for example, as an input waveform signal.

The pitch extraction means is realized by a converting circuit for converting an input waveform signal detected, for example, as an electrical signal, into a digital waveform signal, and by frequency extracting means for extracting pitch frequency in accordance with a period of an input waveform signal from an interval between effective zero crossing points by detecting and determining a zero crossing time of the digital waveform signal and forming the pitch frequency as pitch data, and by a memory unit in which the pitch data is temporarily stored.

Pitch variation data detected by the pitch variation detecting means is frequency variation obtained by subtracting previously extracted pitch frequency data from the currently extracted pitch frequency data from among the pitch frequency data sequentially extracted, for example, from the pitch extraction means.

Another example of the pitch variation data is frequency difference data obtained by subtracting pitch frequency data extracted at a predetermined timing, from pitch frequency data extracted at the most recent timing by the pitch extraction means. In this case, the pitch frequency data at the predetermined timing is, for example, pitch frequency data extracted from the pitch extracting means upon a start of input of the input waveform signal, for example, or pitch frequency data extracted from the pitch extracting means a predetermined period from the start of input of the input waveform signal. A another example is pitch frequency data extracted after a predetermined number of pitch data are extracted after a start of input of the input waveform signal by the pitch extracting means.

On the other hand, the control means comprises, for example, a circuit for converting the pitch variation data to musical sound control parameters to be applied to the musical sound production apparatus.

According to the above construction of the present invention, an electronic guitar, when a performer intentionally changes the strength of the signal from an oscillating string by a choking method or by a tremolo arm operation, the value of the pitch variation data changes accordingly.

Therefore, based on the pitch variation data, the control means can control a characteristic of the musical sound produced by the musical sound production apparatus, such as a timbre, sound volume or pitch, thereby enriching the expression of the musical sound. In particular, an electronic guitar can change the pitch variation data by changing not only the strength of an operation but also the speed of an operation, by choking or a tremolo arm operation, resulting in a further richer expression.

Next, the present invention also provides means for generating a periodic signal and means for controlling a characteristic of the musical sound produced by the musical sound production apparatus by the control signal produced based on pitch variation data and the periodic signal.

In addition, the control means may be constructed such that the above variable control operation can be conducted at the same time as the pitch data is extracted from the pitch extraction means or at the same time as the periodic signal is produced from the periodic signal production means.

As a concrete example of the above construction, the periodic signal production means can be realized by a low frequency oscillation means (LFO) for producing a low frequency signal such as a sine wave, triangular wave, saw-tooth wave or a rectangular wave.

The control means, for example, converts pitch variation data using a predetermined conversion function and adds the converted value to the periodic signal. The control means further provides, for example, a tremolo effect or a vibrato effect to a musical sound produced by the musical sound production apparatus by using above added value.

According to the above construction of the present invention, an effect of a pitch variation amount is added to the effect applied to the musical sound by the periodic production means, thereby achieving a richer expression.

Further, the control means performs a variable control of the musical sound not only at the same time as a periodic signal is produced but also at the same time as the pitch extraction means produces a new pitch data, when pitch variation data detected from the pitch variation detecting means continuously changes. Therefore, even if the performer changes, for example, a pitch of the musical sound at a quick passage by using a choking method, the control means can follow the variation quickly.

A further mode of the present invention, comprises a pitch variation data correcting means for correcting pitch variation data obtained by the abovementioned pitch variation detection means, and control means coupled to the pitch variation data correcting means for variably controlling the characteristics of the musical sound to be produced by the musical sound production apparatus based on the pitch variation data corrected by the correcting means.

In this case the pitch variation data correcting means corrects the pitch variation data to represent a predetermined variation width (for example, zero) or to have the same value as that of the pitch variation data detected by the pitch variation detecting means at the previous timing when the width of the pitch variation based on the pitch variation data is greater than the predetermined value. The pitch variation data correcting means may correct the pitch variation data in accordance with the magnitude of the pitch based on the pitch data.

According to the above construction of the present invention, for an electronic guitar, even when the performer quickly changes the pitch of a string by a performance method such as glissando or trill, the pitch variation amount data is corrected such that it does not exceed the allowable value, thereby enabling smooth control of the musical sound and providing the desired variation.

The last conceived mode of the present invention, in addition to the above construction, further comprises a velocity extracting means for extracting velocity data from the input waveform signal and a control means coupled to the pitch variation detecting means and to said velocity extracting means for variably controlling a characteristic of the musical sound to be produced by the musical sound production apparatus based on the pitch variation data and the velocity data.

The above control means can be realized by a construction in which the pitch variation data is converted by a predetermined conversion function, the converted value is multiplied a value determined by the velocity data, the multiplied value is added to the periodic signal and the characteristic of a sound produced from the musical sound production apparatus is controlled by the added value. Thus, the velocity data can be converted by a different predetermined conversion function.

According to the above construction of the present invention, for an electronic guitar, the characteristics of the musical sound produced by the musical sound production apparatus, such as timbre, volume, or pitch, can be delicately changed not only by a tremolo operation but also by an amplitude, namely, velocity data produced when the string is picked, thus enabling more natural and richer musical expression to be produced.

The present invention can be naturally applied to a musical instrument other than an electronic guitar, providing the electronical musical instrument is of a type in which performance and operation can be detected as an input waveform signal.

A Brief Description of the Drawings

The other object and features of the present invention will be easily understood by a person skilled in the art by referring to the preferred embodiments accompanied by the attached drawings.

FIG. 1 shows a view of the construction of an electronic guitar relating to all the embodiments, FIG. 2 is a general flow chart applied to all the embodiments, FIG. 3 is an operational flow chart of an interruption processing routine applied to all the embodiments, FIG. 4 is an operational flow chart for explaining a note-on processing routine applied to the first embodiment, FIG. 5 is an operational flow chart for explaining a timer interrupt routine applied to the first embodiment, FIGS. 6(*a*) to 6(*e*) are views for explaining an operation of a timer interrupt routine of the first embodiment, FIG. 7 is an operational flow chart for explaining a timer interrupt routine of the second embodiment, FIGS. 8(*a*) to 8(*e*) are operational views for explaining a timer interrupt routine of the second embodiment, FIG. 9 shows an operational flow-chart for explaining a note-on processing routine applied to the third to sixth embodiments, FIG. 10 depicts an operational flow chart for explaining a pitch variation processing routine of the third embodiment, FIG. 11 represents an operational flow chart for explaining a timer interrupt routine applied to the third to eighth embodiments, FIGS. 12(*a*) to 12(*e*) are views for explaining the musical sound control data production process applied to the third and seventh embodiments, FIG. 13 is an operational flow chart of a pitch variation processing routine applied to the fourth embodiment, FIGS. 14(*a*) to 14(*e*) are views for explaining a musical sound control data production process applied to the fourth and eighth embodiments, FIG. 15 depicts an operational flow chart for explaining a pitch variation processing routine of the fifth embodiment, FIGS. 16(*a*) to 16(*e*) are views for explaining a musical sound control data production process of the fifth embodiment, FIG. 17 is an operational flow chart for explaining a pitch variation processing routine of the sixth embodiment, FIGS. 18(*a*) to 18(*e*) are views for explaining a musical sound control data production process of the sixth embodiment, FIG. 19 is an operational flow chart for explaining a note-on variation of the seventh and eighth embodiments, FIG. 20 shows an operational flow chart for explaining a pitch variation processing routine, according to the seventh embodiment.

FIG. 21 depicts an operational flow chart for explaining a pitch variation processing routine according to the eighth embodiment.

Description of the Preferred Embodiments

Embodiments of the present invention will be explained in detail hereinafter by referring to the drawings.

The present invention is applied to an electronic guitar having, for example, six metal-strings extended on a body, which a performer plays by selecting a desired string by pressing it onto a fret (a finger plate) provided under the metal strings, and picking the string. However, it is a matter of course that the present invention can be applied to electronic musical instruments of other types, for detecting a pitch frequency from input waveform signals caused by acoustic oscillation other than string oscillation.

FIG. 1 is a construction view relating to all the embodiments.

Conversion portion 1 comprises hexa pickups. These are mounted on all of the six strings (not shown) and each pickup detects oscillations from each string. Electrical signals representing six kinds of string oscillation waveforms detected by these pickups are input to pitch extracting circuit 2.

Pitch extracting circuit 2 removes high frequency components by passing respective outputs through six low pass filters (not shown), thereby obtaining six kinds of basic waveform signals for facilitating detection of the pitch components (basic frequency components). After digitizing each of six kinds of basic waveform signals, a start, namely, a note-on of string oscillation, is detected. Thereafter an oscillation frequency, namely a pitch frequency, is detected (a change of a pitch), an end, namely, noteoff, of a string oscillation is detected, and respective information is latched in a memory circuit (not shown). In an operation of the seventh and eighth embodiments described later, a velocity is detected upon detecting a note-on.

Specifically, each peak value or a zero crossing point immediately after the peak value is detected from the basic waveform signals. A note-on is detected by detecting that the amplitude value (peak value) exceeds the predetermined threshold value. In an operation of the seventh and eighth embodiments described later, an amplitude value upon detecting a note-on is deemed as a velocity. On the other hand, a pitch frequency is sequentially detected by performing an arithmetic operation and a judgment of an interval between respective zero crossing points. Further, a note-off is detected by detecting that the amplitude value (a peak value) exceeds the predetermined threshold value at continual predetermined timings.

The above processes are conducted individually using a time division scheme using six kinds of digitized basic waveform signals, and is conducted independently for every string.

Every time pitch extracting circuit 2 detects any one note-on, pitch frequency or note-off, it outputs an interrupt signal INT #1 to a central processing unit (CPU) 3. Therefore, data representing the respective detections and latched in pitch extraction circuit 2 are read into RAM 302 in the CPU3 through a bus BUS.

A detailed structure of pitch extracting circuit 2 for performing the above operation is disclosed in U.S. Ser. No. 252,914 (filed on Oct. 3, 1988 and invented by Uchiyama).

Further, CPU3 in FIG. 1 has a memory, such as ROM 301 or RAM 302. ROM 301 is a nonvolatile memory containing a program for controlling various musical sounds. RAM 302 is a rewritable memory used as a work area for various variables and data for control.

Musical sound production unit 6 comprises musical sound production circuit 601, D/A converter 602, amplifier 603 and speaker 604. It produces a musical sound in accordance with control by a CPU3. A MIDI (musical instrument digital interface) circuit is provided as the input of musical sound production circuit 601 and is connected to CPU3 through bus MIDI-BUS. MIDI is a standard determined for transferring data between electronic musical instruments. Where musical sound production unit 6 is provided in the body of guitar, an internal interface other than MIDI may be provided.

Low frequency oscillator (LFO) 5 generates a low frequency oscillation signal to produce a vibrato effect, a tremolo effect or a growl effect.

Period data forming unit 4 generates periodic LFO data Lj (as described later) of a digital signal based on the low frequency signal and latches them in a memory circuit. Every time LFO data Lj is generated, an interrupt signal INT #2 is output to CPU 3. Therefore, LFO data Lj, latched in period data forming unit 4 based on a control signal (not shown), is read into RAM 302 in CPU 3 through a bus BUS. The above LFO 5 and period data forming unit 4 may be realized by software in CPU 3.

A method of operating an electronic string instrument constructed as shown in FIG. 1 is realized by eight embodiments as shown hereinafter. These embodiments are explained sequentially, 1. An explanation of the first embodiment FIG. 2 shows a general flow chart of a program executed by CPU 3.

As shown, when the power is activated, the system is initialized at a step S21 and thereafter steps S22 to S29 are executed.

At step S22, a judgment is made as to whether or not a note-on of an operated string exists. If the judgment is yes, a sound production channel of a note-on corresponding to the number of the string is selected and a note-on process is executed out at step S23. The note-on judgment at step S22 is conducted by determining whether or not a note-on flag stored in RAM 302 within CPU 3 shown in FIG. 1 is turned on (logic "1"). The note-on flag is set according to the process of FIG. 3. A note-on process at step S23 is described by referring to FIG. 4.

Next, at step S24 a judgment is made as to whether or not a note-off exists for a musical sound to be currently produced. If the judgment is YES, a note-off process is conducted at step S25. A note-off judgment at step S24 is conducted by judging whether a note-off flag stored in RAM 302 in CPU 3 in FIG. 1 is on. A note-off flag is set by a process described later with reference to FIG. 3. A note-off process at step S25 is executed as follows. A sound production channel-on flag (as explained later with reference to FIG. 4) of a sound production channel which has been subjected to a note-on process is reset from among sound channels corresponding to string numbers which is subjected to a note-off process, set according to the process shown in FIG. 3. The data is output to musical sound production circuit 601 (FIG. 1). Therefore, a corresponding musical sound is extinguished in circuit 601.

Next, if the judgment at step S24 is NO, or after the process of step S25 is completed, it is determined at step S26 whether pitch change data, namely, data for changing the pitch of a newly produced musical sound, has arrived. This judgment is executed by determining whether or not a pitch variation flag stored in RAM 302 in FIG. 1 is on. The pitch variation flag is set by a process described later with reference to FIG. 3.

When the judgment at step S26 is YES, a pitch variation process is conducted at step S27. At this step a pitch of a musical sound is controlled to correspond to a pitch frequency, whose change is based on data input by the process described in FIG. 3. Pitch data Bj at the current timing is stored in RAM 302 (FIG. 1).

Conversely if the judgment at step S26 is NO or after the process at step S27 is completed, a judgment is made at step S28 as to whether a switch for switching a timbre or an effect is changed. If the judgment is YES, the process corresponding to respective switches, for example timbre change, is conducted at step S29. If the judgment at step S28 is NO or after the process at step S29 is completed, the process is turned to step S22 and the same sequence is repeated.

The process shown in FIG. 3 is an interrupt processing routine which is executed when interrupt signal INT#1 is output to CPU3 by pitch extracting circuit 2 of FIG. 1 in response to a string operation.

In FIG. 3, when CPU3 receives interrupt signal INT#1 from pitch extracting circuit 2, it outputs a control signal (not shown) to the same circuit 1 following the prescribed process, and pitch detection data latched in the same circuit 2 is read at step S31. The data is saved in RAM 302 (FIG. 1). The pitch detection data latched in pitch extracting circuit 2 comprises the number of the string to be subjected to a note-on, data representing a note-on, an amplitude value (called a note-on level hereinafter) of the basic waveform and a pitch frequency where pitch extracting circuit 2 detects a note-on. The pitch detection data latched in pitch extracting circuit 2 comprises the number of a string which is subjected to a pitch change, data representing a pitch change and a new pitch frequency where a pitch change is executed. Further, the pitch detection data comprises the number of a string to be subjected to a note-off and data representing a note-off, where a note-off is detected. At the step following step S31, a judgment of the kind of respective pitch data is made.

At step S32 a judgment is made as to whether or not the pitch data is note-on data. If the judgment is YES, data comprising a string number, a pitch frequency and a note-on level is saved in RAM 302 in CPU3 at step S33. These operations execute a note-on pre-processing.

If the judgment as step S32 is NO, a judgment at step S34 is made as to whether or not the data is note-off data. If the judgment is YES, a note-off flag is set on at step S35 and the string number is saved in RAM 302. These operations execute a note-off pre-processing.

If the judgment at step S34 is NO, the following step, S36, is executed. At step S36, a judgment is made as to whether the pitch detection data from pitch extracting circuit 2 represents a change in pitch frequency. If the judgment is YES, the string number and the pitch frequency is saved in RAM 302 at step S37. This operation executes a pitch variation pre-processing. At the same time, the pitch variation flag is turned on.

If the judgment at step S36 is NO, the process routine of FIG. 3 is completed and the program is again returned to the general flow chart shown in FIG. 2.

The above three kinds of flag are used to decide whether respective processes are executed in the general flow shown in FIG. 2. More specifically, they are used in the judgment at steps S22, S24 and S26, as already explained.

Next, a process of performing an arithmetic operation on a pitch frequency data and a process of forming musical sound controlling data in these flows will be explained.

FIG. 4 shows an operation flow chart representing a note-on process in step S23 of the general flow of FIG. 2.

Firstly, at step S41 in FIG. 4, data for starting sound production, namely, sound production channel j, keycode (date designating a pitch) a velocity, an initial value of musical sound control data Gj corresponding to the above sound production channel j and bendor data and so on is calculated. At step S42 following step S41, these respective data are transmitted to musical sound production circuit 601 and production of the corresponding musical sound starts.

The sound production channel means a plurality of channels for a time divisional process, the plurality of channels being used to enable musical sound production circuit 601 of FIG. 1 simultaneously produce a plurality of musical sounds (polyphonic), for example, eight channels producing eight sounds at the same time. If one channel is assigned to each string the sound production channels may be comprised of six channels. When sound production channel j is arithmetically operated at step S41, the sound production channel is assigned to a vacant channel or a sound production channel which was subjected to a note-on at the oldest timing, for example, where there is no vacant channel.

Next, a key code at step S41 of FIG. 4 is obtained by an arithmetic operation of a string number and a pitch frequency saved in RAM 302 in step S33 of the interrupt process routine of FIG. 3. Further, a velocity is obtained from an arithmetic operation of a note-on level similarly saved in RAM 302.

On the other hand, musical sound control data initial value at step S41 is an initial value at a note-on timing of musical sound control data Gj described later, and the initial value is, for example, zero, as shown in FIG. 6, described later.

After the processes at steps S41 and S42 of FIG. 4, a note-off or high release control data is transmitted at step S43 to musical sound production circuit 601 (FIG. 1) with regard to other sound production channels to which the same string number, to which sound production channel number j is assigned, is assigned at step S41. Based on this transmission, musical sound production circuit 601 performs a sound extinguishing operation with regard to the sound production channel. Where a musical sound has a long envelope after a note-off, a reverberation sound is sometimes sustained for a long period, and high release is controlled to compulsively lower the envelope upon a note-off, and to perform a fast sound extinguishing operation to remove the state in which a reverberation sound is sustained. The operation is discretionally selected by a switch.

Therefore when a performer picks a particular string to conduct a note-on based on that string, the musical sound which has been produced by the same string by the prescribed process is extinguished by the above process and a new sound production operation is executed by the string.

Next, at step S44 of FIG. 4, a pitch frequency upon note-on (a value stored in RAM 302 and used from a key code at step S41) is stored in RAM 302 (FIG. 1) as a frequency data Aj of a previous timing corresponding to sound production channel number j and a frequency data Bj of the present (most recent) timing. These operations will be described in detail later.

At the last step, S45, a sound production channel-on flag stored in RAM 302 corresponding to sound production channel j in which the above sound production starts is set. Thus, it becomes recognizable that sound production channel j is in the period in which a sound is produced and a note-on process is completed. Then the program is shifted to step S24 of FIG. 2.

Next, a process at a timer interrupt routine is explained.

CPU3 of FIG. 1 reads LFO data from period data forming unit 4 through a bus BUS every time a timer interrupt is caused by interrupt signal INT#2 output from period data forming unit 4 of FIG. 1 at a period of 5–20 msec. At every such interrupt the time interrupt routine of FIG. 5 is executed. During this routine, the above LFO data is modulated by a variation amount of a pitch frequency, and musical sound control data for controlling the timbre, volume or pitch of a musical sound is produced. Hereinafter, the operation will be explained by referring to the operational flow chart of FIG. 5.

At step S51, an initial value of sound production channel number j, namely, channel number 1, is set. Next, at step S52 a sound production channel-on flag stored in RAM 302 corresponding to the current sound production channel number j is determined, thereby judging whether the current sound production channel j is production a sound. If the judgment is NO, step S54 is executed and if it is YES, step S53 is executed.

At step S53, the difference between the previous frequency data Aj and the current (most recent) frequency data Bj is calculated and the result is set to the frequency variation amount data Cj and current frequency data Bj is set in the previous frequency data Aj position. Effect data Ej is calculated by converting frequency variation amount data Cj using an appropriate conversion function f (for example a monotonically increasing function). The calculated value is set in RAM 302 (FIG. 1). The current (most recent) frequency data Bj is data sequentially renewed and set in step S27 of FIG. 2.

In the next step, S54, sound production channel number j is incremented. The above process is repeated until processing of the last sound production channel, namely, the sixth channel is completed. When the channel number is higher than six, it is checked whether the process of step S53 concerning all the channels which are producing sound is executed.

When all the channels have been processed, step S56 is executed. At step S56, new musical sound control data Gj for six strings are formed by LFO data Lj (j=1 to 6), sequentially input from period data forming unit 4 and set in RAM 302 (FIG. 1) and by effect data Ej (j=1 to 6) formed in step S53. The data is transferred to musical sound production circuit 601 (FIG. 1) and stored in RAM 302.

Variation characteristic of actual musical sound control data produced by the previously explained operation, will be explained by referring to FIG. 6.

FIG. 6(*a*) shows the previous frequency data Aj and the current (most recent) frequency data Bj. The value $F_{ON}$ at t=0 is an initial value occurring on note-on. When a frequency data variation as shown in FIG. 6(*a*) is input, frequency variation amount data Cj becomes a value such as shown in FIG. 6(*c*). Then, effect data Ej=f(Cj) is expressed, for example, by a function as shown in FIG. 6(*d*). The data is added to LFO data Lj of FIG. 6(*b*), thereby making newly formed musical sound control data Gj as shown in FIG. 6(*e*).

Based on musical sound control data Gj of FIG. 6(*e*) musical sound production circuit 601 (FIG. 1) controls a parameter (such as a harmonic structure ratio), thereby realizing a rich performance or expression. The characteristic shown in FIGS. 6(*c*) or 6(*d*), based on a characteristic of frequency data change in FIG. 6(*a*), is presented by a choking performing method by an operation of a tremolo arm by a performer and in particular is changed in accordance with operation speed. Therefore, such performing operation enables a performer to freely vary musical sound control data Gj shown in FIG. 6(*e*), thereby realizing various kinds of performance expression.

2. Explanation of an operation of the second embodiment

In this embodiment an operation concerning a timer interrupt routine is different from the first embodiment. In the first embodiment, the frequency variation amount data is arithmetically operated as a difference between the previous value of pitch frequency data varying with time, and the current (most recent) value thereof, namely so-called differential value. In contrast, in the second embodiment, frequency variation amount data is arithmetically calculated as the difference between the value of pitch frequency data at a certain timing (especially at a sound production start timing) and the current (most recent) value. In this case, the relative value of the pitch frequency data is used as a musical sound control parameter, thereby providing a performance effect differing from that of the first embodiment. The other operation is as shown in the first embodiment.

FIG. 7 is an operational flow chart of the second embodiment.

Figure 4:
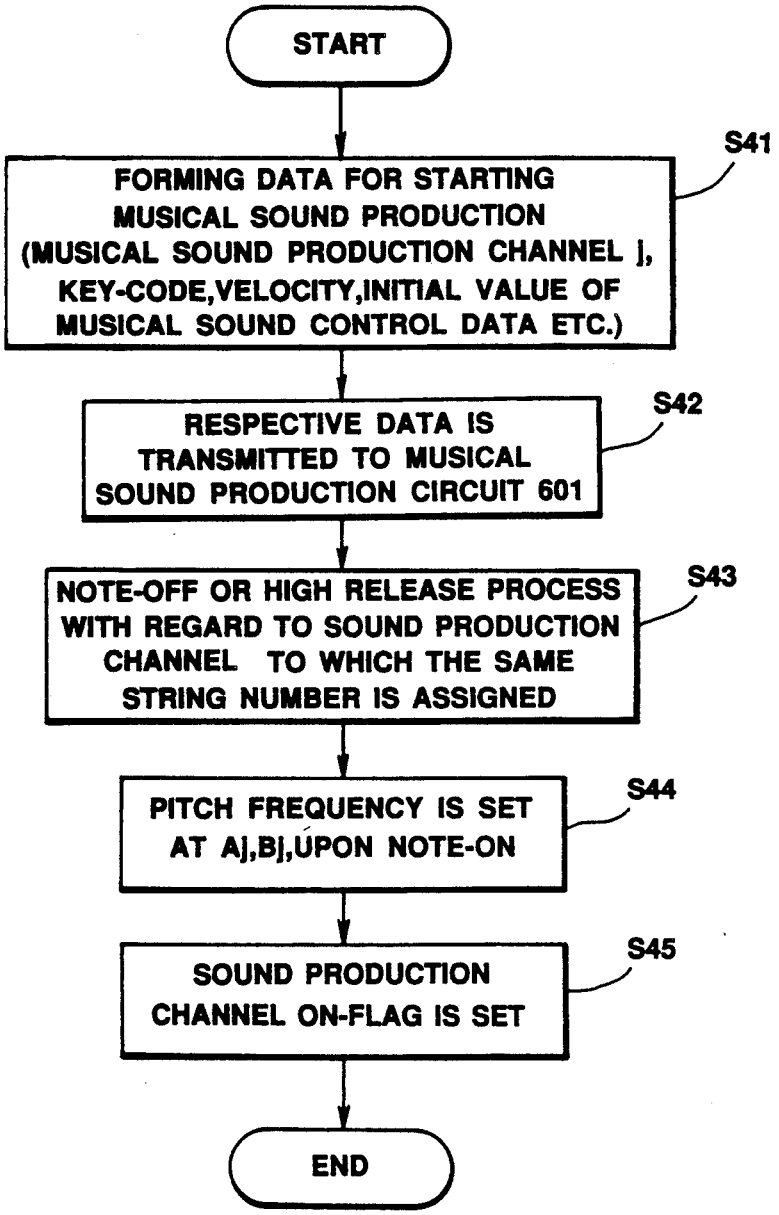
Figure 5:
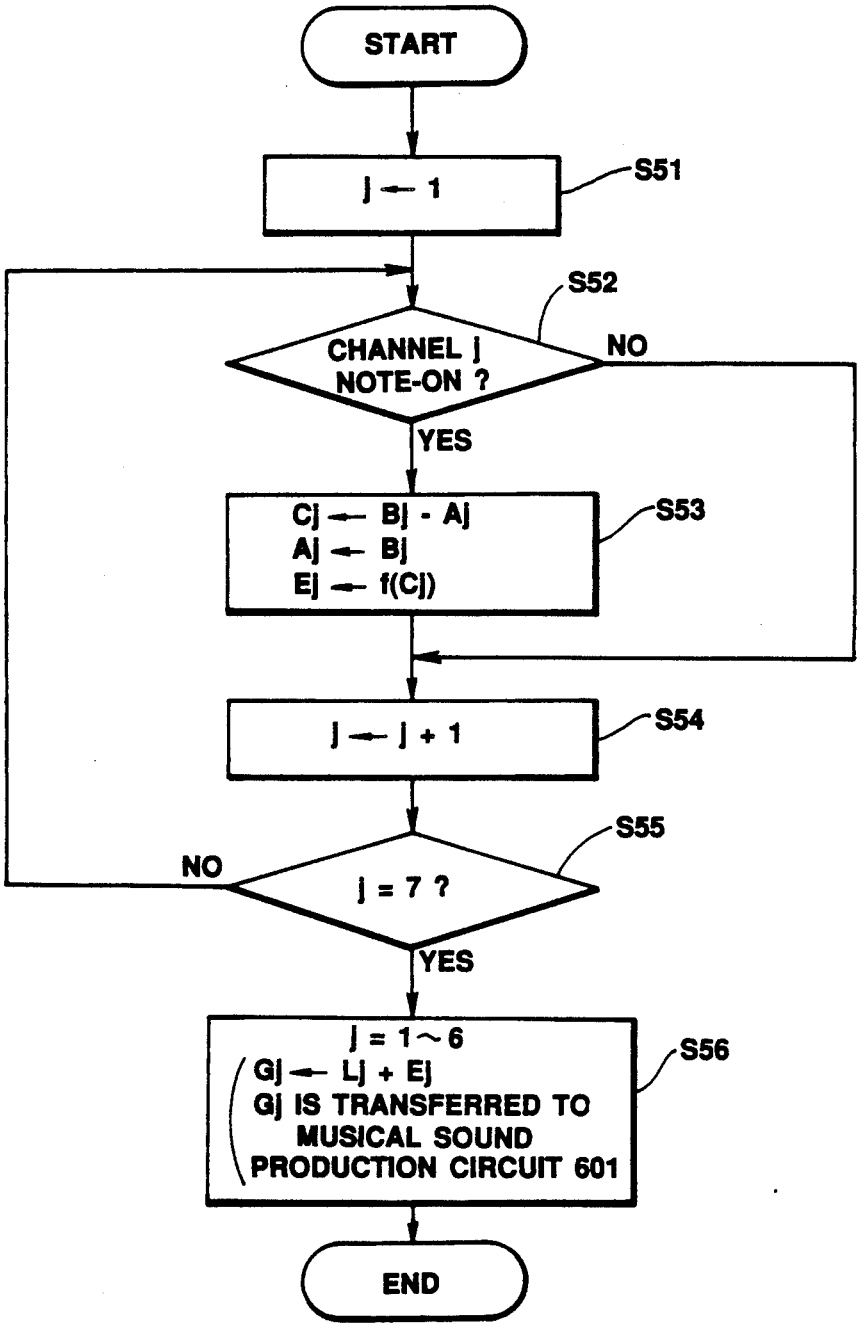
Figure 6A:
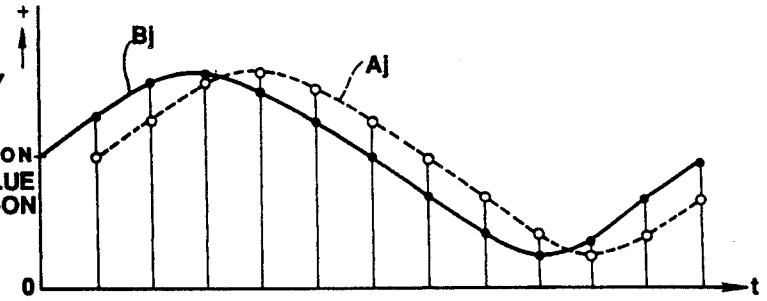
Figure 6B:
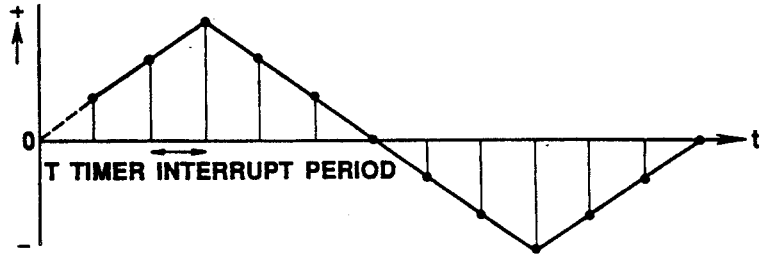
Figure 6C:
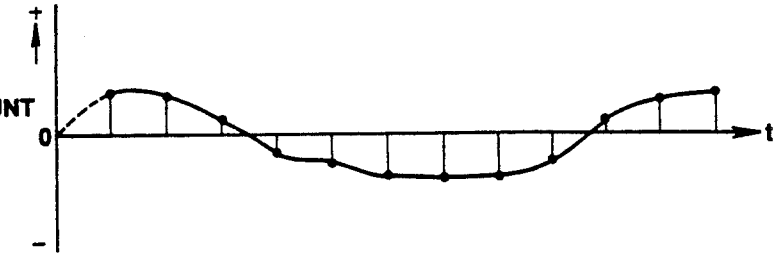
Figure 6D:
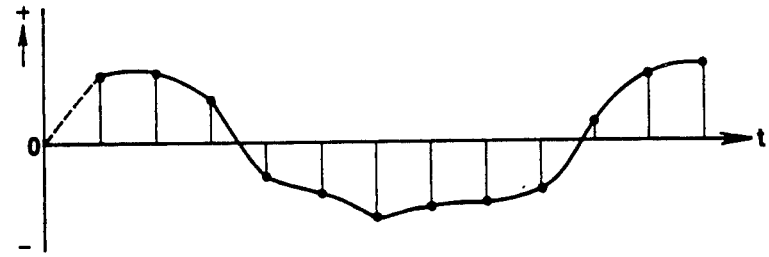
Figure 6E:
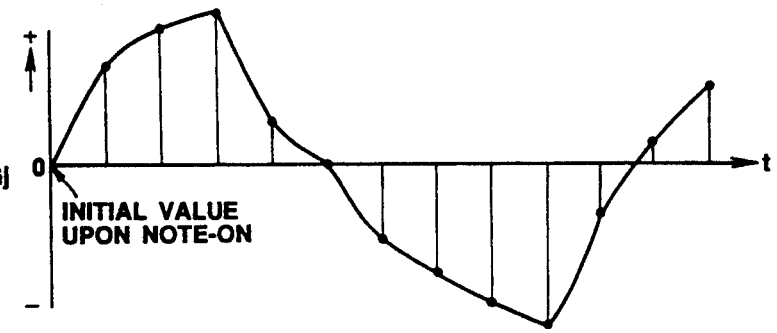
Figure 7:
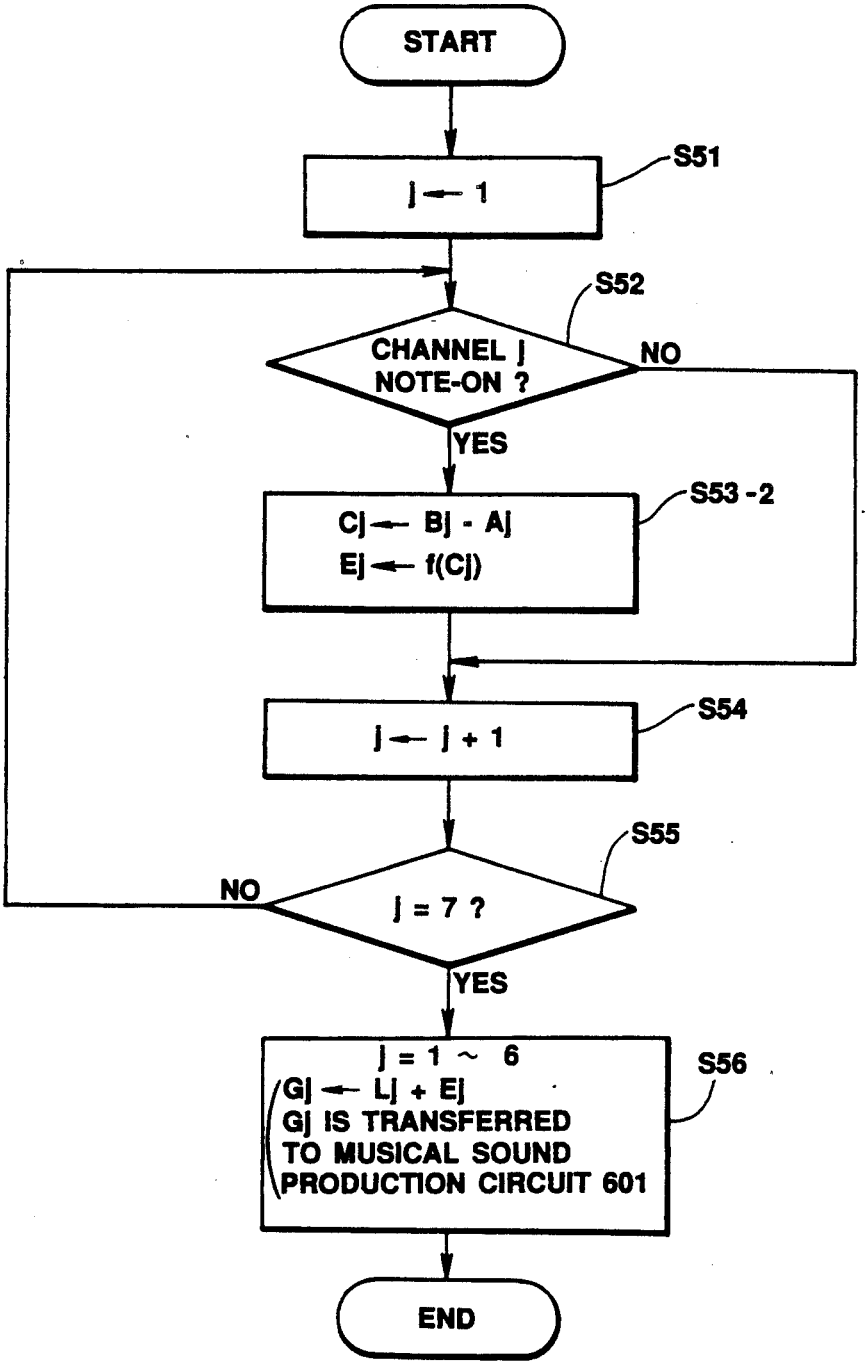
FIGS. 7 and 8 are drawings for explaining an operation of the second embodiment relating to a timer interrupt routine and correspond to FIGS. 5 and 6 of the first embodiment.
Figure 8A:
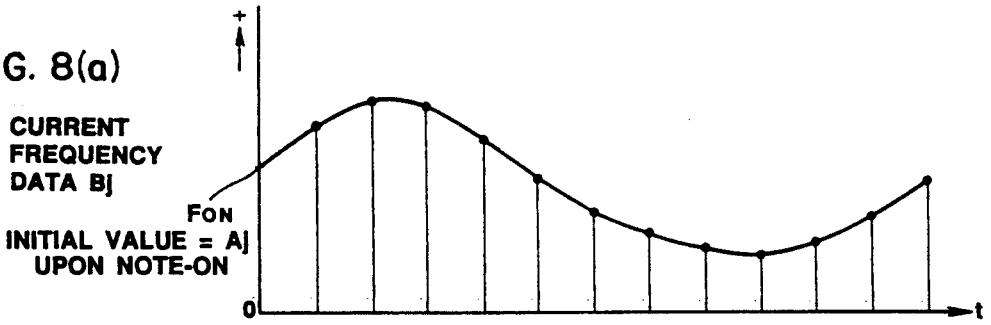
Figure 8B:
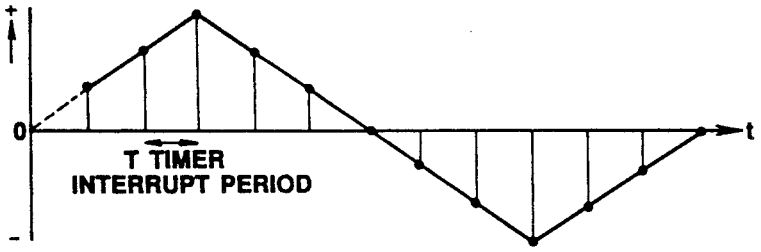
Figure 8C:
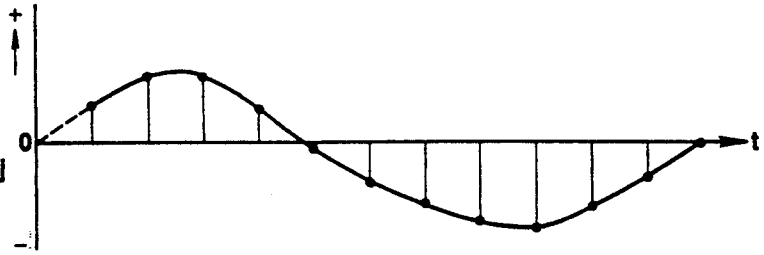
Figure 8D:
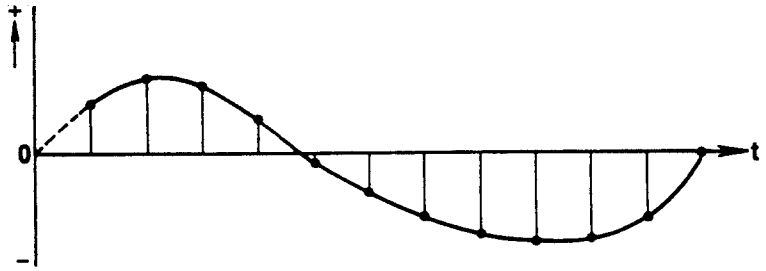
Figure 8E:
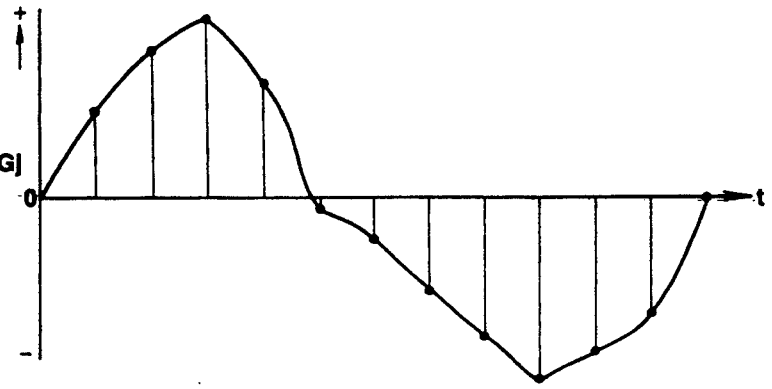

Steps S51 to S56 of FIG. 7 are the same as these steps represented by the same numbers in FIG. 5 relating to the first embodiment exept that step S53-2 of FIG. 7 replaces step S53 of FIG. 5. In step S53-2, previous frequency data Aj is set only upon a note-on (step S44 in FIG. 4) and thereafter it is not renewed. Therefore, frequency variation amount data Cj is obtained from an arithmetic operation of current (most recent) frequency data Bj and previous frequency data Aj set upon a note-on.

Variation characteristics of musical sound control data Gj obtained from the above operations will be explained by referring to FIG. 8.

Current (most recent) frequency data Bj is shown in FIG. 8(*a*). An initial value $F_{ON}$ upon note-on at t=0 is Aj. When frequency data variation as shown in FIG. 8(*a*) is input, frequency variation amount data Cj becomes as shown in FIG. 8(*c*). Then, effect data Ej=f(Cj) becomes a function, for example, as shown in FIG. 8(*d*). The data is added to LFO data Lj of FIG. 8(*b*), thereby producing newly formed musical sound control data Gj as shown in FIG. 8(*e*).

Based on this data, timbre control parameter, for example, is controlled in musical control production circuit 601 (FIG. 1), thereby realizing a rich performance expression. At this time, characteristics of FIGS. 8(*c*) and 8(*d*) based on the characteristic of frequency data variation shown in FIG. 8(*a*) is achieved by a choking or a tremolo arm operation by a performer, and is particularly changed by varying the depth of the operation. This differs from the first embodiment in that the musical sound characteristics change with the speed of the above operation. Therefore, such a performing operation enables a performer to change musical sound control data Gj of FIG. 8(*e*) in accordance with characteristic difference from the first embodiment and to achieve new performance expression.

3. An explanation of the operation of the third embodiment

Next, the third embodiment will be explained. In the first embodiment, to add, for example, a vibrato effect, for example, to a musical sound to be produced, a variation amount of a pitch frequency is received by imposing on an oscillation waveform of LFO. In this case, a musical sound is controlled by executing the timer interrupt routine in FIG. 5, based on interrupt signal INT#2 output at every oscillation of LFO 5, obtained from period data forming unit 4 of FIG. 1.

According to the above control method, even when a performer executes a performing method of varying a musical sound pitch at a fast passage by, for example, a choking method, a control for changing a musical sound is not conducted until the next timing, because musical sound variation control based on a pitch change is carried out based only on a constant timing. Therefore, a musical sound control corresponding to a variation of a pitch by the performer is delayed and a responsive quick musical sound variation such as the timbre or volume of a musical sound to be produced is delayed, thereby causing a bad effect upon performance.

Figure 1:
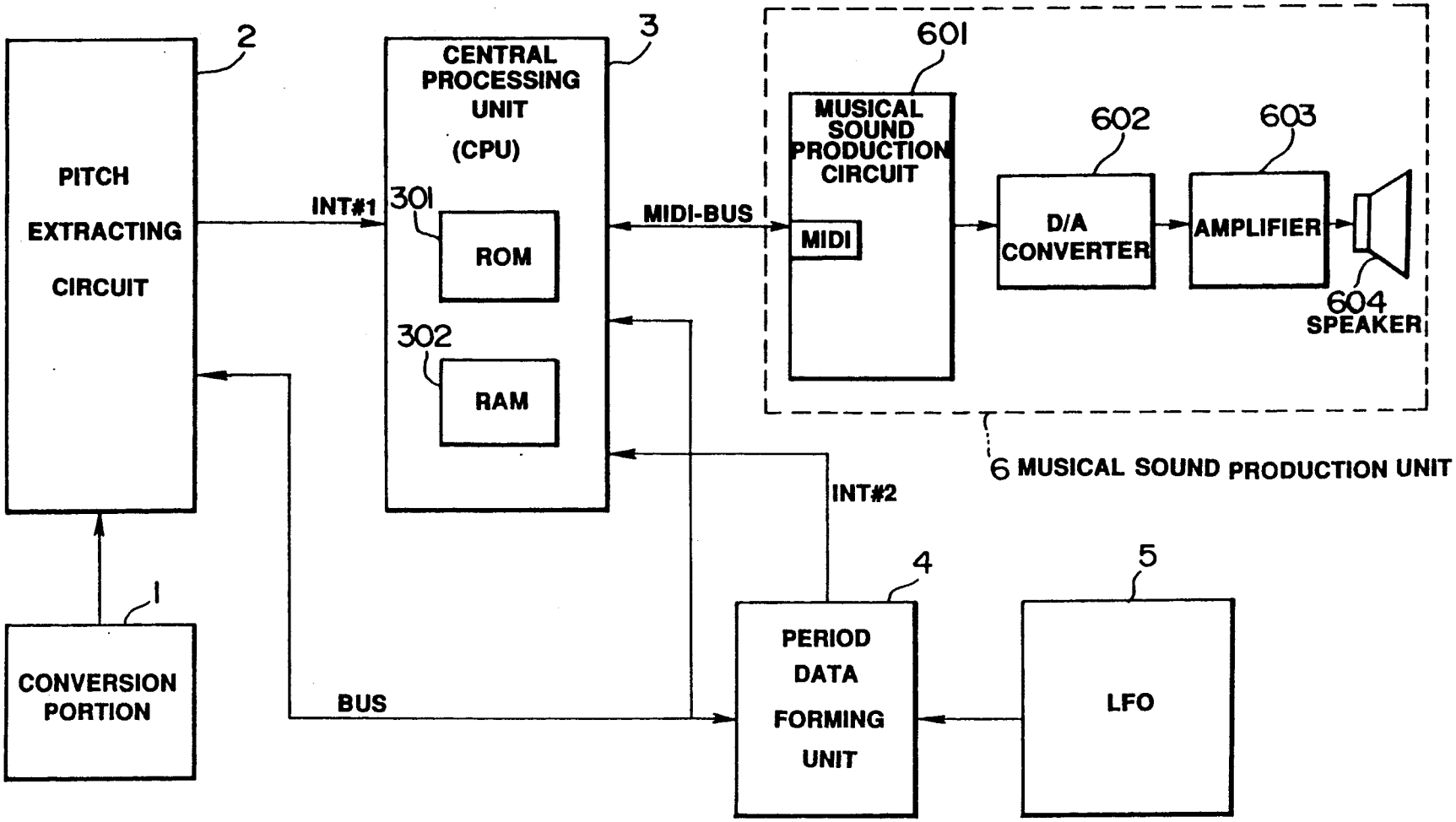

In the third embodiment, a musical sound variation control based on a pitch change is conducted not only at the oscillation timing of LFO 5 of FIG. 1 but also at an every timing at which pitch extraction circuit 2 output new pitch data. This enables a musical sound subjected to a sound production control to follow a variation of pitch even if a performer changes the pitch of a musical sound at a fast passage by using, for example, a choking method.

An operation of the third embodiment will be explained in detail.

Figure 2:
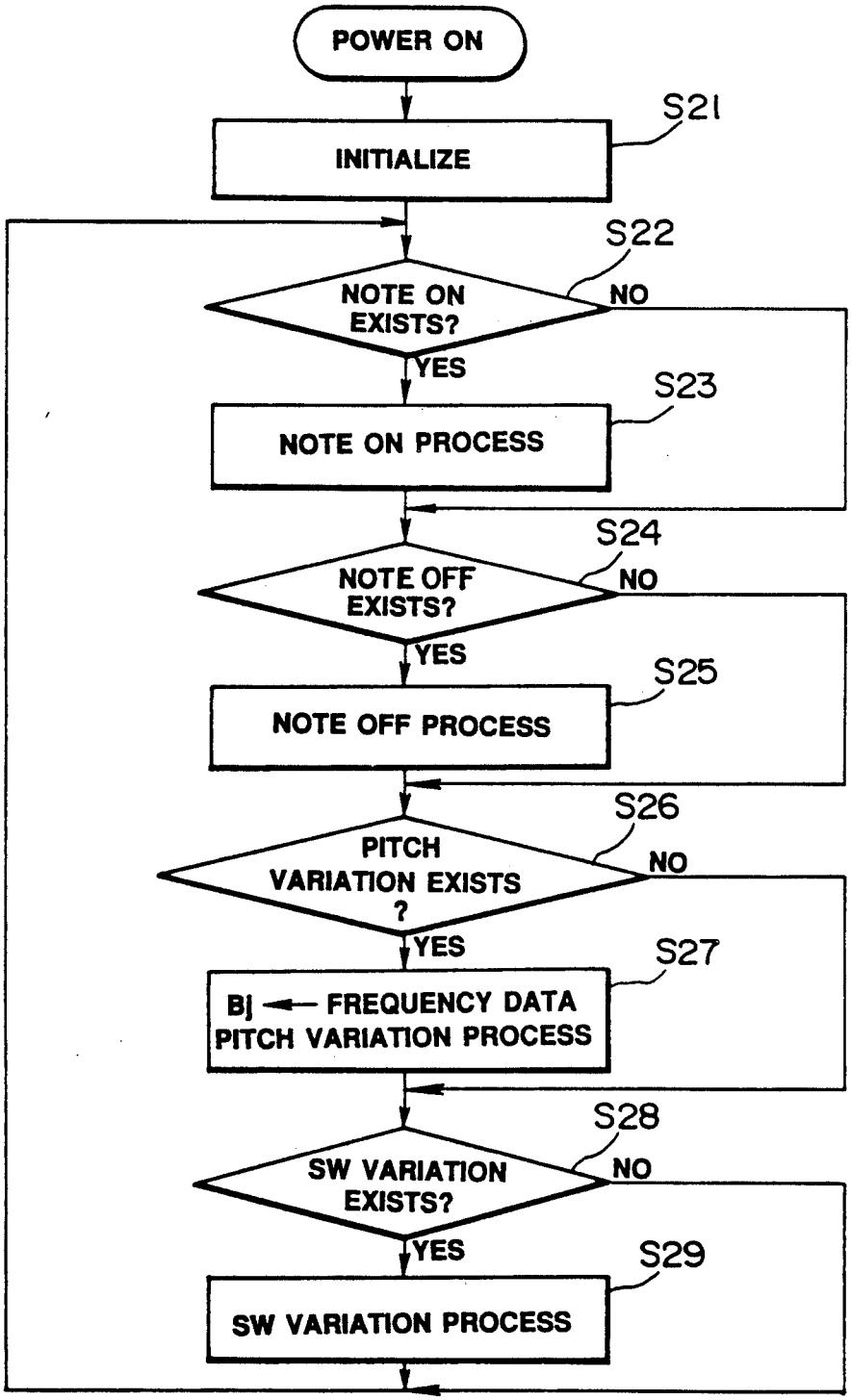
Figure 3:
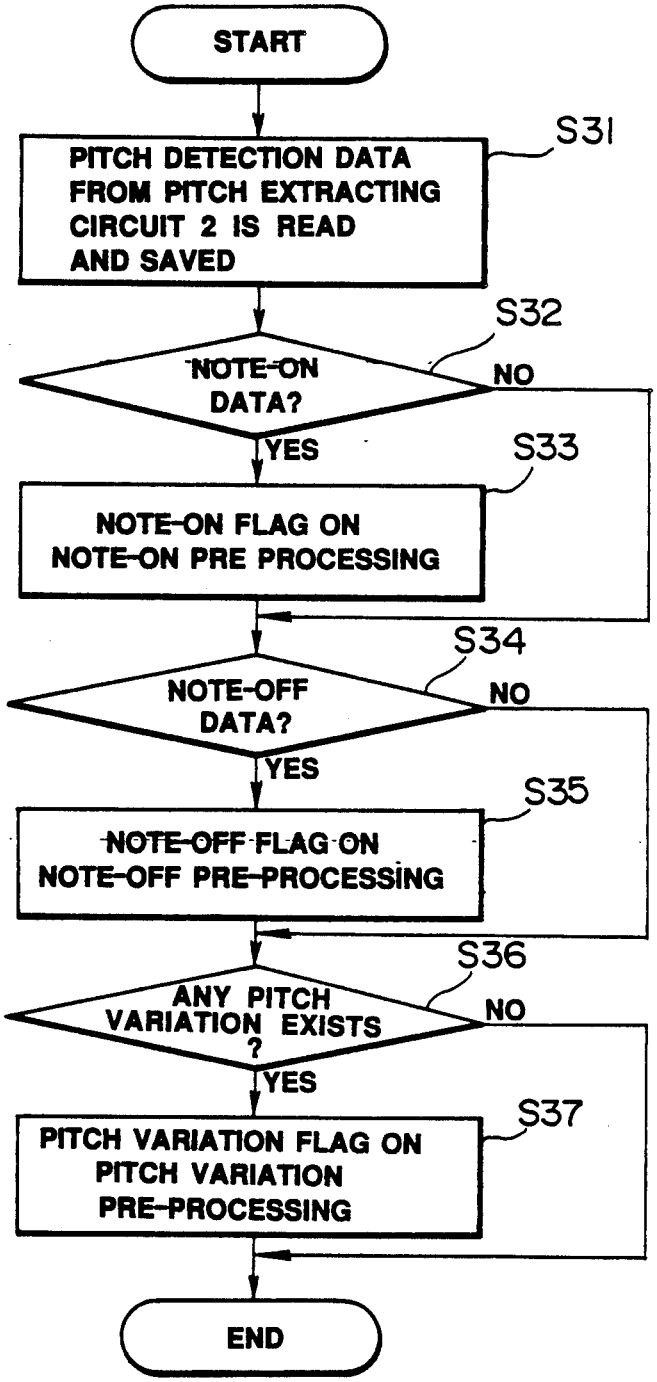

A whole process flow comprising a general flow and an operation flow of an interrupt process routine is the same as in FIGS. 2 and 3 relating to the first embodiment.

Figure 9:
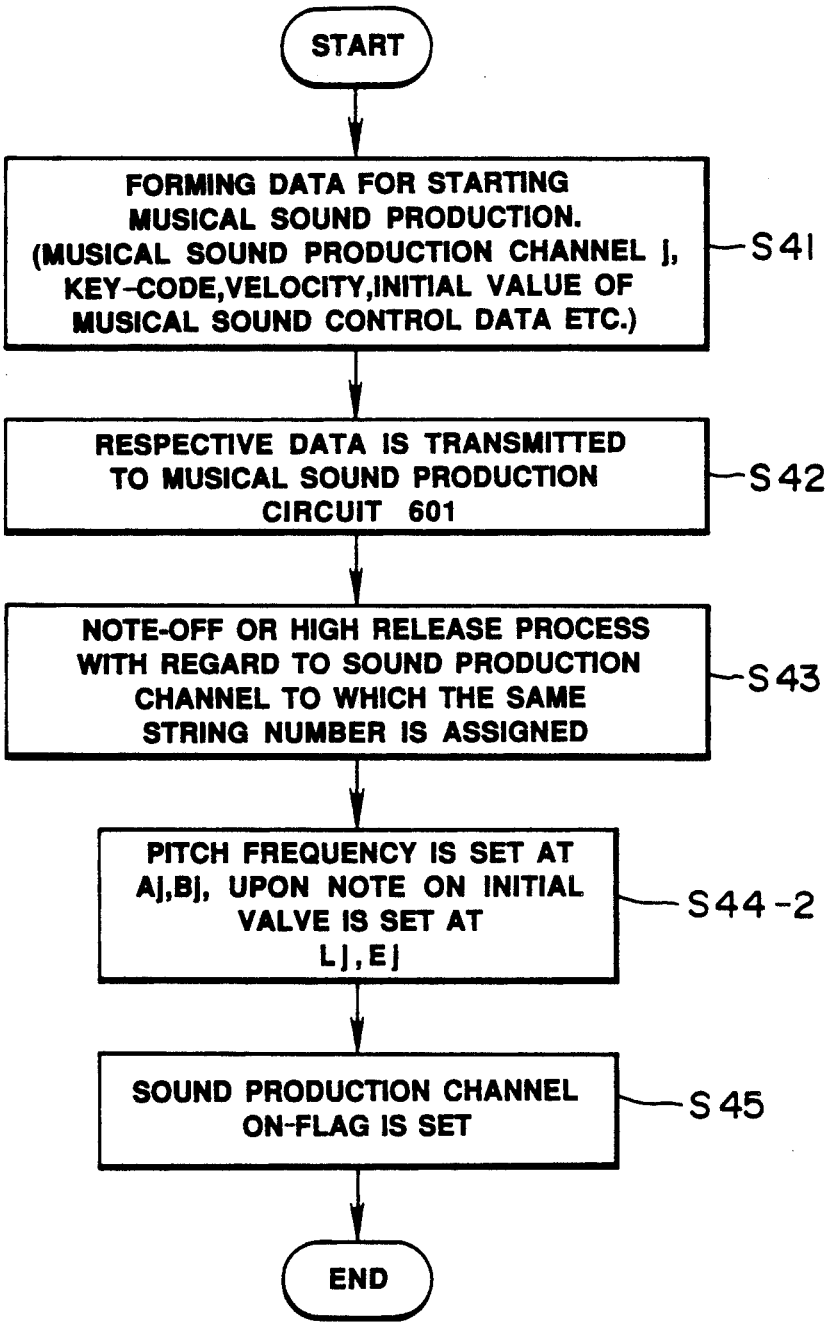

FIG. 9 is an operational flow chart representing a note-on processing at step S23 of the general flow of FIG. 2.

Steps S41 to S45 of FIG. 9 are the same as the steps designated by the same numbers in FIG. 4 relating to the first embodiment, except that step S44-2 in FIG. 9 replaces step S44 in FIG. 4.

In step S44-2, a pitch frequency upon a note-on is stored in RAM 302 (FIG. 1) as the previous frequency data Aj and the current (most recent) frequency data Bj corresponding to the sound production channel j. A pitch frequency upon the above note-on timing is the value stored in RAM 302, which is used to form a key code of step S41. Further, respective initial values of LFO data Lj and effect data Ej (j=1-6) such as 0 is set in RAM 302. These operations will be described in detail later.

Next, a pitch variation processing routine will be explained.

When a variation in pitch is detected by pitch extracting circuit 2 of FIG. 1 and interrupt signal INT#1 is input to CPU 3, the interrupt processing routine of FIG. 3 is executed as explained above and a pitch variation flag is turned on at step S37. Following this process, it advances from step S26 to step S27 in the general flow of FIG. 2. In this step, in addition to an ordinally pitch control of a musical sound, an operation having the following characteristics is executed.

Figure 10:
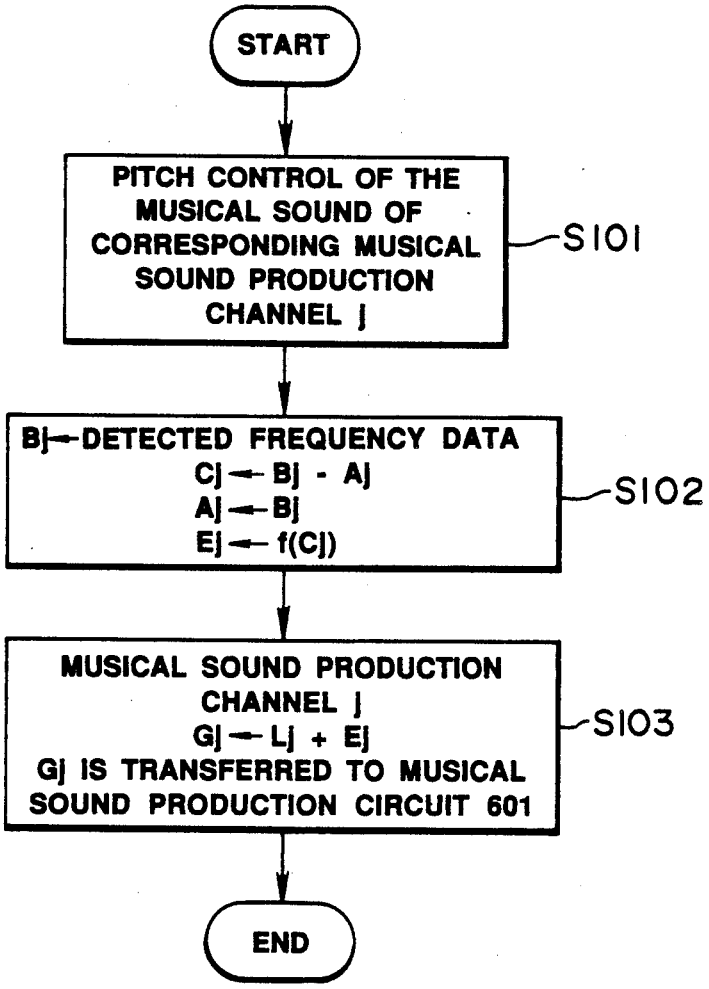

FIG. 10 is an operational flow chart showing in detail, the pitch variation processing routine of step S27 in FIG. 2.

Firstly, at step S101, a new key code is arithmetically operated based on a string number and a new frequency saved in RAM 302 (FIG. 1) at step S37 of the interrupt processing routine of FIG. 3. The above key code is designated for sound production channel j to which the string number is assigned, thereby performing a pitch control of the corresponding musical sound. This is an ordinary pitch control.

Next, at step S102, the newly detected pitch frequency is determined as the current (most recent) frequency data Bj corresponding to sound production channel j. With regard to sound production channel j subjected to the above pitch variation, a difference between the above Bj and the frequency data Aj is obtained and is set as frequency variation amount data Cj. The previous frequency data Aj is a pitch frequency upon previous pitch variation processing and the initial value is a pitch frequency upon a note-on timing which is set at step S44-2 of the note-on process of FIG. 9. Then, with regard to sound production channel j subjected to the above pitch variation, the current frequency data Bj is set at Aj and frequency variation amount data Cj is converted by an appropriate conversion function f (for example, a monotonously increasing function), thereby enabling effect data Ej to be operated arithmetically. The value is set in RAM 302 (FIG. 1).

At step S103, the most recent LFO data Lj corresponding to sound production channel j are read out. They are selected from among LFO data sequentially set in RAM 302 in CPU 3 through a bus BUS by interrupt signal INT#2 output from frequency data forming unit 4 of FIG. 1 at a period of about 5 to 20 msec. The LFO data is added to effect data Ej relating to sound production channel j and formed at step S102, thereby, forming a new musical sound control data Gj corresponding to sound production channel j which is subjected to a pitch variation. The musical sound control data is transferred to musical sound production circuit 601 (FIG. 1) and stored in RAM 302. If a pitch change process routine operates after the note-on processing of step S23 (namely FIG. 9 ) of FIG. 2 and before the timer interrupt routine of the later described FIG. 11, the initial value 0 of LFO data Lj set at step S 44-2 of a note-on process of FIG. 9 is used. Then, the pitch variation processing routine of FIG. 10 is completed and a program advances to step S28 of general flow of FIG. 2.

Next, a timer interrupt routine will be explained.

Every time a timer interrupt is applied by interrupt signal INT#2 which is output from period data forming unit 4 of FIG. 1 at a period of about 5-20 msec as described above, LFO data Lj (j=1-6) corresponding to six strings are set in RAM 302 in CPU3 through a bus BUS from period data forming unit 4. The timer interrupt routine shown in an operation flow chart of FIG. 11 is executed simultaneously.

Figure 11:
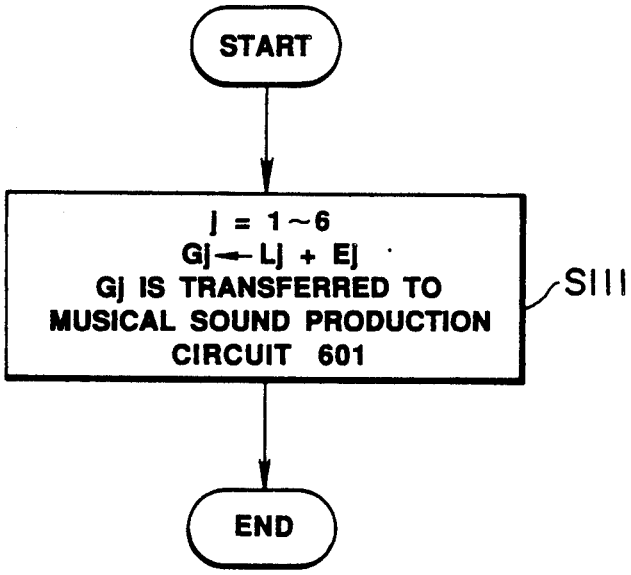

In step S111 of the timer interrupt routine of FIG. 11, LFO data Lj (j=1-6) corresponding to six strings and effect data Ej (j=1-6) corresponding to six strings are added together, thereby forming new musical sound control data Gj corresponding to six strings. The data is transferred to musical sound production circuit 601 (FIG. 1) and stored in RAM 302. Effect data Ej is the most current recent value selected from among the data at step S102 of the pitch variation processing routine of FIG. 10. If a timer interrupt operates after a note-on processing at step S23 (namely FIG. 9) of FIG. 2 and before an operation of a pitch variation process routine at step S27 (namely in FIG. 10) in FIG. 2, an initial value 0 of effect data Ej (j=1-6) set at step S44-2 of a note-on process of FIG. 9 is used.

As explained above, musical sound control data Gj is formed at both an input timing of LFo data and a pitch change timing. This constitutes a great feature of this embodiment.

Actual variation characteristics of musical sound control data Gj produced by the above process will be explained by referring to FIG. 12.

Figures 12A, 12B, 12C, 12D, 12E:
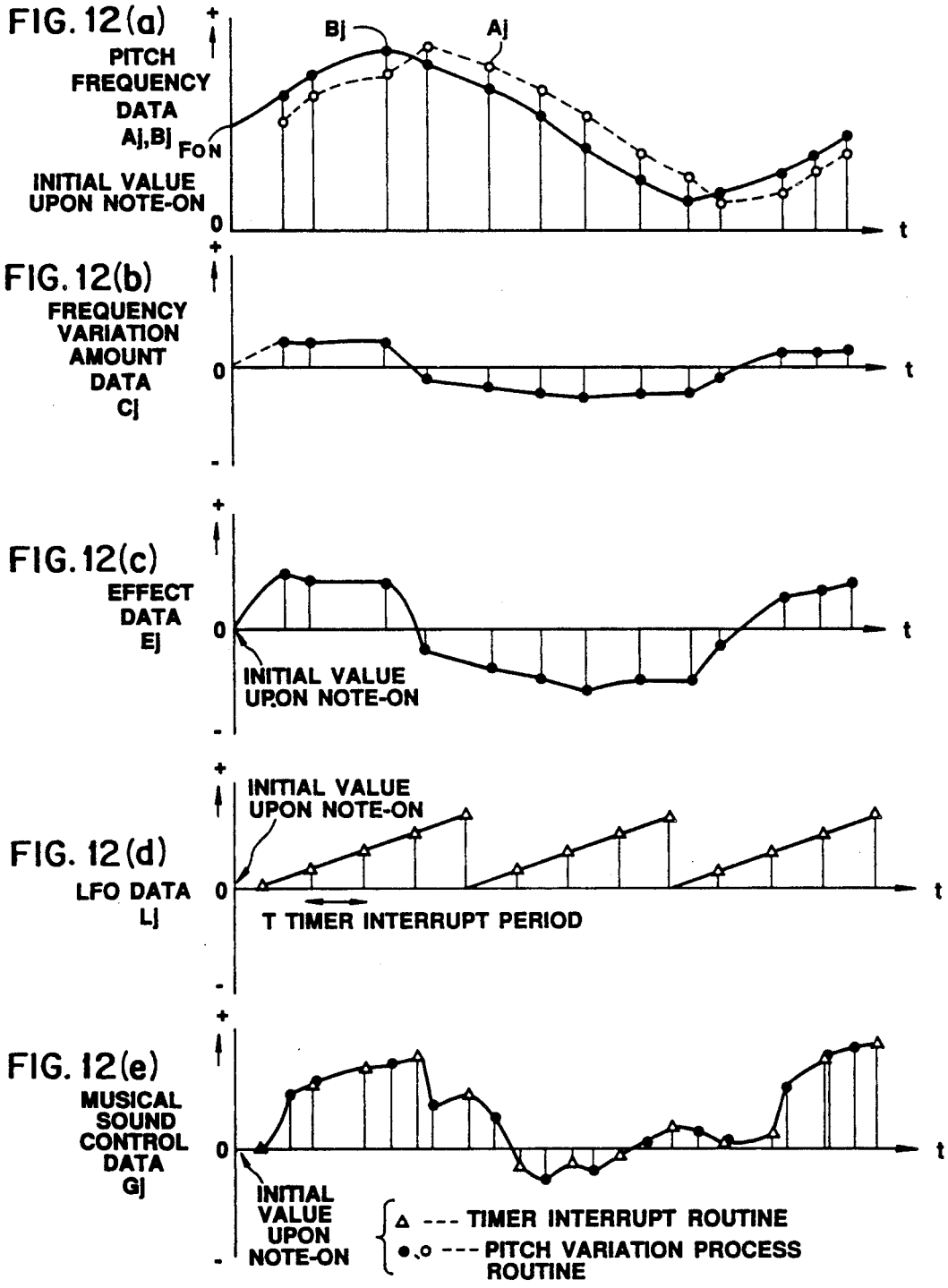

Respective plots () and ⊖ in FIG. 12(*a*) are previous frequency data Aj and current (most recent) frequency data Bj obtained by an arithmetic operation which is executed at step S102 of a pitch variation processing routine of FIG. 10 every time respective pitches change. The value $F_{ON}$ at t=0 is an initial value determined upon a note-on processing (S44-2 of FIG. 9).

When a frequency data variation as shown in FIG. 12(*a*) is input, frequency variation amount data Cj arithmetically operated at step S102 of FIG. 10 is obtained at a timing such as that shown by the plot ● of FIG. 12(*b*). In correspondence with this frequency variation amount data Cj, effect data Ej=f(Cj) is obtained, for example, as a plot ● of FIG. 12(*c*).

The effect data is added to the most recent value of LFO data Lj obtained at every timer interrupt period T shown by a plot (Δ) of FIG. 12(*d*) in step S103 of FIG. 10, thereby newly producing musical sound control data Gj at the timing shown by the plot ● of FIG. 12(*e*).

In addition, when new LFO data Lj is input at every interrupt period T shown by the plot (Δ) of FIG. 12(*d*), the above LFO data Lj is added to the most recent effect data Ej at step S111 of FIG. 11, thereby providing musical sound control data Gj at a timing shown by a plot (Δ) of FIG. 12(*e*).

Based on musical sound control data Gj of FIG. 12(*e*), a timbre control parameter (overtone structure ratio, for example) is controlled in musical sound production circuit 601 (FIG. 1), thereby realizing a rich performance expression. At this time, characteristics of FIGS. 12(*b*) and 12(*c*) based on the frequency data variation of FIG. 12(*a*) can be varied by a variation in operation speed of a choking or a tremolo arm operation by a performer. Therefore, such a performance enables a performer to freely change musical sound control data Gj of FIG. 12(*e*), thereby realizing various performance expressions.

Musical sound control data Gj can be obtained not only at an input timing of LFO data Lj shown by the plot (Δ) in FIG. 12(*e*) but also at a pitch variation timing shown by the plot ●. Therefore, even when a performer changes a pitch of a musical sound at a fast passage by, for example, a choking method, in such a state that LFO data Lj is obtained at a long timer interrupt period T, a musical sound control is carried out such that change in musical sound pitch is closely followed.

4. An explanation of the operation of the fourth embodiment

The fourth embodiment will be explained. This embodiment is obtained by combining the second and third embodiments. Namely, in the fourth embodiment, as in the third embodiment, a musical sound variation control based on a pitch variation is executed, not only at the oscillation timing of LFO 5 of FIG. 1, but also every time pitch extracting circuit 2 produces new pitch data. Then, frequency variation amount data is arithmetically operated as a difference between the value of pitch frequency data at a predetermined timing (particularly upon start of sound production) and the current (most recent) pitch frequency data. Therefore, even if a performer changes the pitch of a musical sound at a fast passage by a choking method, a musical sound subjected to the sound production control can quickly follow the variation in pitch. A relative value of pitch frequency data is used simultaneously as a musical sound control parameter, thereby providing performance effect difference from that in the third embodiment.

An operation of the fourth embodiment will be explained in detail.

A whole process flow comprising a general flow and an operational flow of the interrupt processing routine is as shown in FIGS. 2 and 3 relating to the first embodiment, just like the third embodiment. A note-on process and an operational flow of a timer interrupt routine are as shown in FIGS. 9 and 11 relating to the third embodiment.

Figure 13:
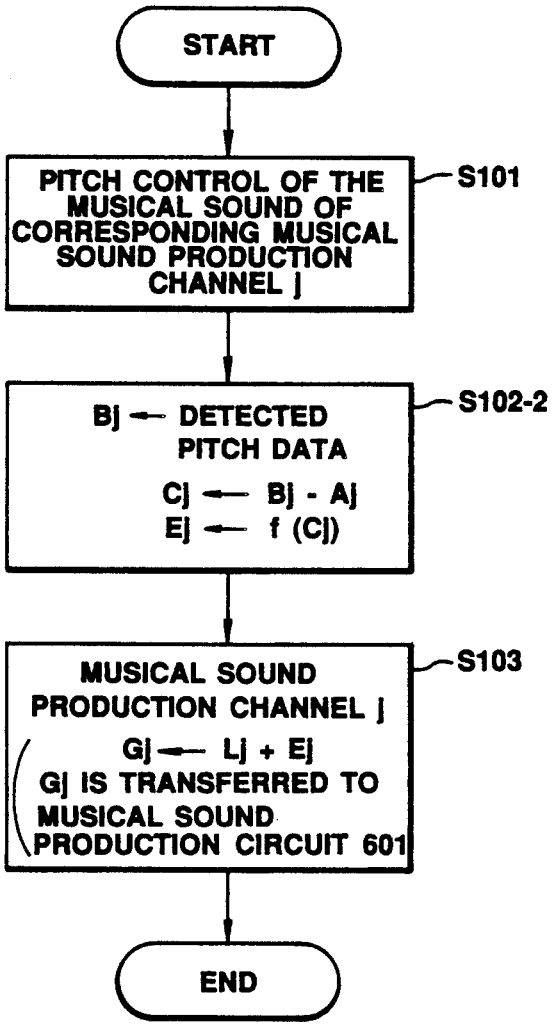

FIG. 13 is an operational flow chart of a pitch variation process routine relating to the fourth embodiment.

In FIG. 13 steps S101 and S103 are the same as the steps designated by the same numbers in the third embodiment in FIG. 10, except that step S102-2 of FIG. 13 replaces step S102 of FIG. 10. At step S102-2, the previous frequency data Aj is set only upon a note-on (step S44-2 of FIG. 9) as for step S53-2 of FIG. 7 relating to the second embodiment and thereafter the previous frequency data Aj is not renewed. Therefore, frequency variation amount data Cj is obtained through an arithmetic operation of the current (most recent) frequency data Bj and the previous frequency data Aj set upon a note-on timing.

Effect data Ej is obtained by an arithmetic operation based on frequency variation amount data Cj obtained as described above, and further musical sound control data Gj is obtained at step S103.

Based on frequency variation amount data Cj and effect data Ej, which are arithmetically operated at step S102-2, the timer interrupt routine of FIG. 11 is also operated. Therefore, musical sound control data Gj is also produced at a variation timing of LFO data Lj, as for the third embodiment.

Figures 14A, 14B, 14C, 14D, 14E:
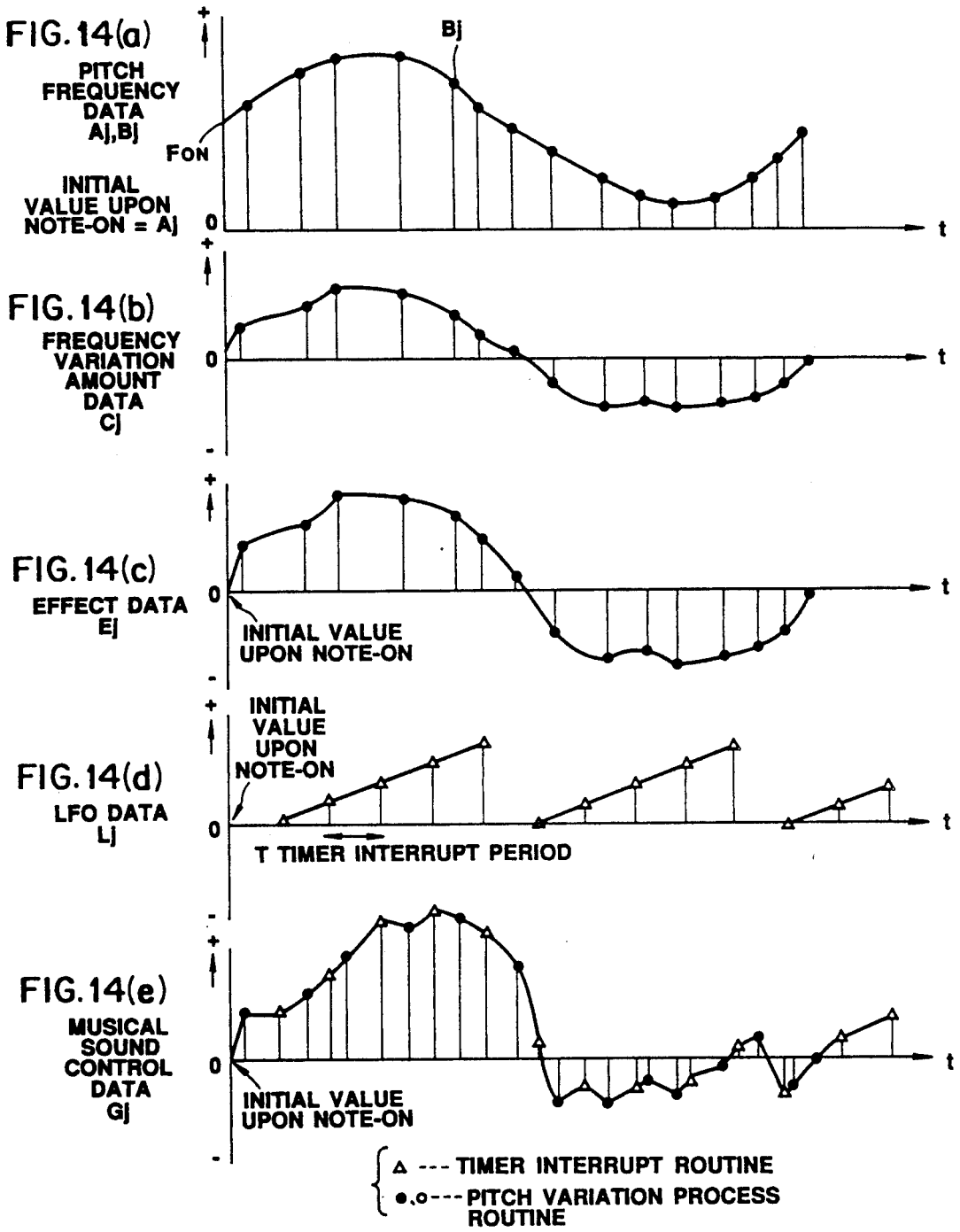

Variation characteristics of musical sound control data Gj obtained from the above operation is explained by referring to FIG. 14.

FIG. 14(*a*) shows current (most recent) frequency data Bj. Initial value $F_{ON}$ upon a note-on timing at $t=0$ becomes Aj. When a frequency data variation as shown in FIG. 14(*a*) is input, frequency variation amount data Cj becomes the value shown in FIG. 14(*b*). At this time, effect data $Ej=f(Cj)$ becomes, for example, a function as shown in FIG. 14(*c*). This effect data is added to LFO data Lj of FIG. 14(*d*), thereby providing newly formed musical sound control data Gj as shown in FIG. 14(*e*).

Based on the musical sound control data Gj, musical sound production circuit 601 (FIG. 1) controls a parameter, for example, for controlling timbre, thereby, realizing a rich performance and expression. At this time, characteristics of FIGS. 14(*c*) and(*d*) based on frequency data variation characteristic of FIG. 14(*a*) can be changed by a choking or a tremolo arm operation by a performer and particularly by a variation in the depth of the operation. This is similar to the aforementioned second embodiment and differs from the third embodiment in which characteristic of musical sound is changed by a variation in speed of the above operation. Therefore, by conducting such performance and operation, a performer can change musical sound control data Gj of FIG. 14(*e*) using characteristics which differ from those of the third embodiment, thereby obtaining a new performance and expression.

As for the third embodiment, musical sound control data Gj is, as shown in FIG. 14(*e*), obtained not only at a input timing of LFO data Lj represented by a plot (Δ), but also at a pitch variation timing represented by a plot ●. Therefore, even if a performer changes the pitch of a musical sound at a fast passage, a musical sound control which follows this variation can be well conducted. This feature is different from the aforementioned second embodiment.

5. An explanation of the operation of the fifth embodiment

Next, the fifth embodiment will be explained. In the first to fourth embodiments, frequency variation data is arithmetically operated as a difference between the previous pitch frequency data varying with time and the current (most recent) pitch frequency data, namely, the differential value. The effect data is arithmetically operated based on the differential value itself and is added to the LFO data, thereby providing musical sound control data based on which a musical sound is controlled.

However, if such control is conducted, a musical sound variation desired by a performer may not always be obtained, depending on the performance method. Namely, if a performance method such as glissando or trill is adopted by a performer, the variation in pitch of the string is abrupt and the amount of variation is large. Therefore, accompanied by the variation, musical sound control data corresponding to the variation in the pitch increases abruptly. Thus, as the musical sound controlled by musical sound control data is subjected to large abrupt change, a sound is obtained which is different from the intention of the performer, and the desired effect is not always obtained.

In the fifth embodiment, if a pitch frequency changes abruptly, frequency variation data is changed to 0 or to an initial value to avoid an abrupt variation. Thus, even if a performer abruptly changes a pitch of a string by using a performance method such as glissando or trill, the frequency variation data is amended such that it does not exceed an allowable value, thereby providing a smooth musical sound control.

An operation of the fifth embodiment will be explained in detail. In the fifth embodiment, as in the third embodiment, musical sound variation control based on a pitch variation is conducted not only at the oscillation timing LFO 5 of FIG. 1 but also at a timing in which the pitch extracting circuit outputs a new pitch data.

A whole process flow comprising a general flow and an operational flow of an interrupt processing routine is as shown in FIGS. 2 and 3 relating to the first embodiment, just like the third embodiment. A note-on process and the operation flow of the timer interrupt routine is as shown in FIGS. 9 and 11 relating to the third embodiment.

Figure 15:
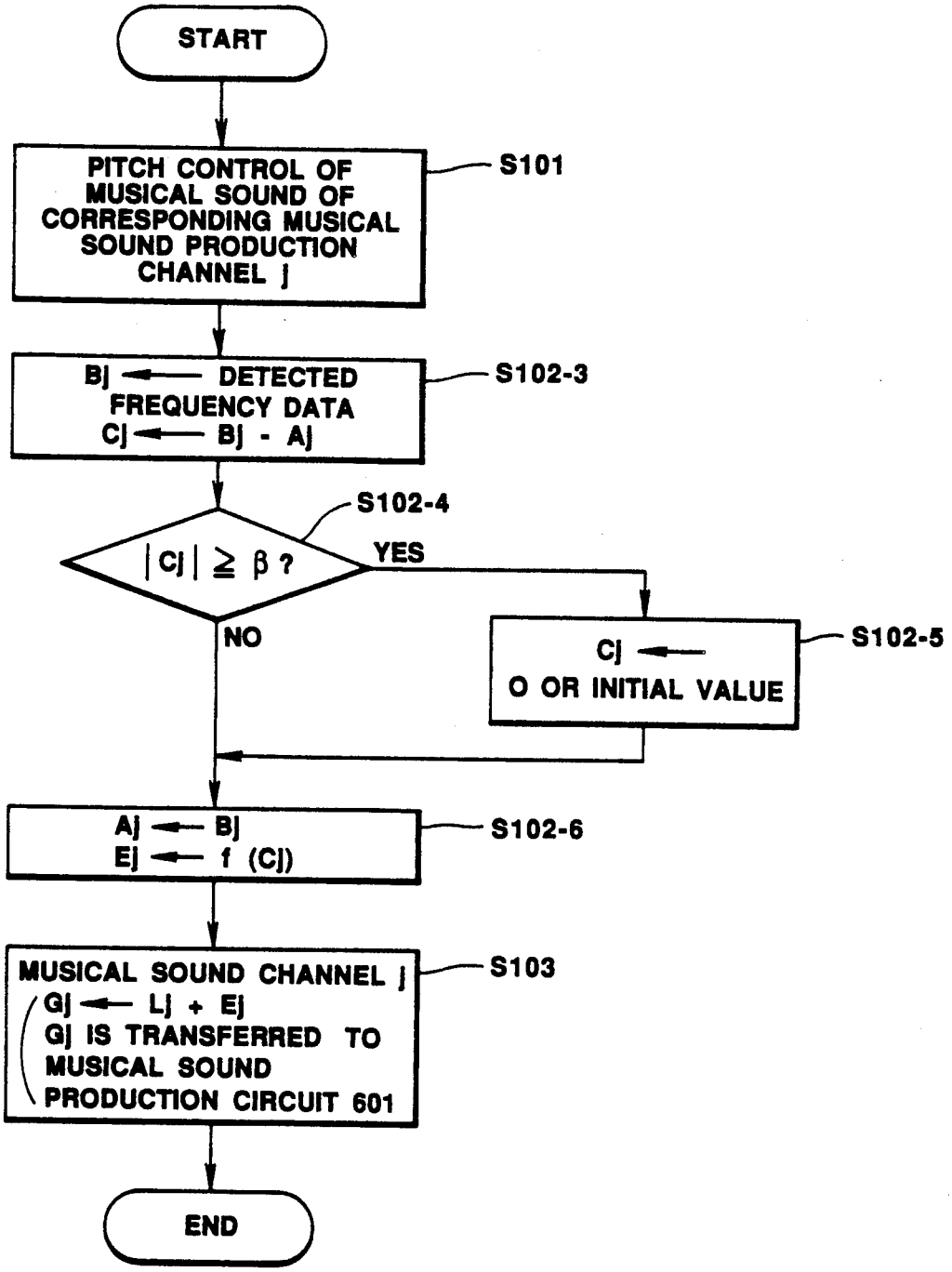

FIG. 15 is an operational flow chart of the pitch variation processing routine relating to the fifth embodiment. As in the third embodiment, this processing routine enables musical sound variation control based on the pitch variation to be conducted not only at an oscillation timing of LFO5 in FIG. 1 but also every time the pitch extracting circuit 2 produces a new pitch data. Therefore, even if a performer changes the pitch of a musical sound at a fast passage, the musical sound subjected to the sound production control can quickly follow the variation of the pitch.

In FIG. 15, steps S101 and S103 are the same as the steps designated by the same numbers in the third embodiment in FIG. 10, except that steps S102-3 to S102-6 of FIG. 15 replace step S102 of FIG. 10.

These processes differ from those of step S102 of FIG. 10, as follows.

The process of S102-3 in which frequency variation amount data Cj is arithmetically calculated as the difference between Bj and Aj after Bj is determined, is as shown in step S102.

Next, in step S102-4, predetermined data $\beta$ is, compared with the absolute value of frequency variation amount data Cj. If the absolute value of frequency variation data Cj is larger than $\beta$, namely, if the current frequency data Bj varies by more than the allowable value as compared with the previous frequency data Aj, step S102-5 is executed and Cj is set at 0 or an initial value. In contrast, in a case $|Cj| < \beta$, step S102-6 is executed. The above process corrects Cj appropriately.

Following the above process, at step S102-6, with regard to sound production channel j subjected to a pitch variation, the current frequency data Bj is set to Aj and frequency variation amount data Cj is converted by an appropriate conversion function f (for example, a monotonously increasing function), thereby arithmetically operating effect data Ej, the value of which is set in RAM 302 (FIG. 1).

In S103, effect data Ej, arithmetically operated based on frequency variation amount data Cj corrected as shown in above, is added to LFO data Lj, thereby producing musical sound control data Gj. Sound control data Gj is transferred to musical sound production circuit 601(FIG. 1) and is stored in RAM 302.

Based on effect data Ej arithmetically calculated in the above step S102-6, the timer interrupt routine of FIG. 11 is also operated.

As explained above, musical sound control data Gj is produced both at an input timing of LFO data and at a variation timing of pitch, as is in the third embodiment. This data makes a change of the musical sound smooth. This is an important feature of the fifth embodiment. Variation characteristics of actual musical sound control data Gj produced by the above process will be explained by referring to FIG. 16.

Figures 16A, 16B, 16C, 16D, 16E:
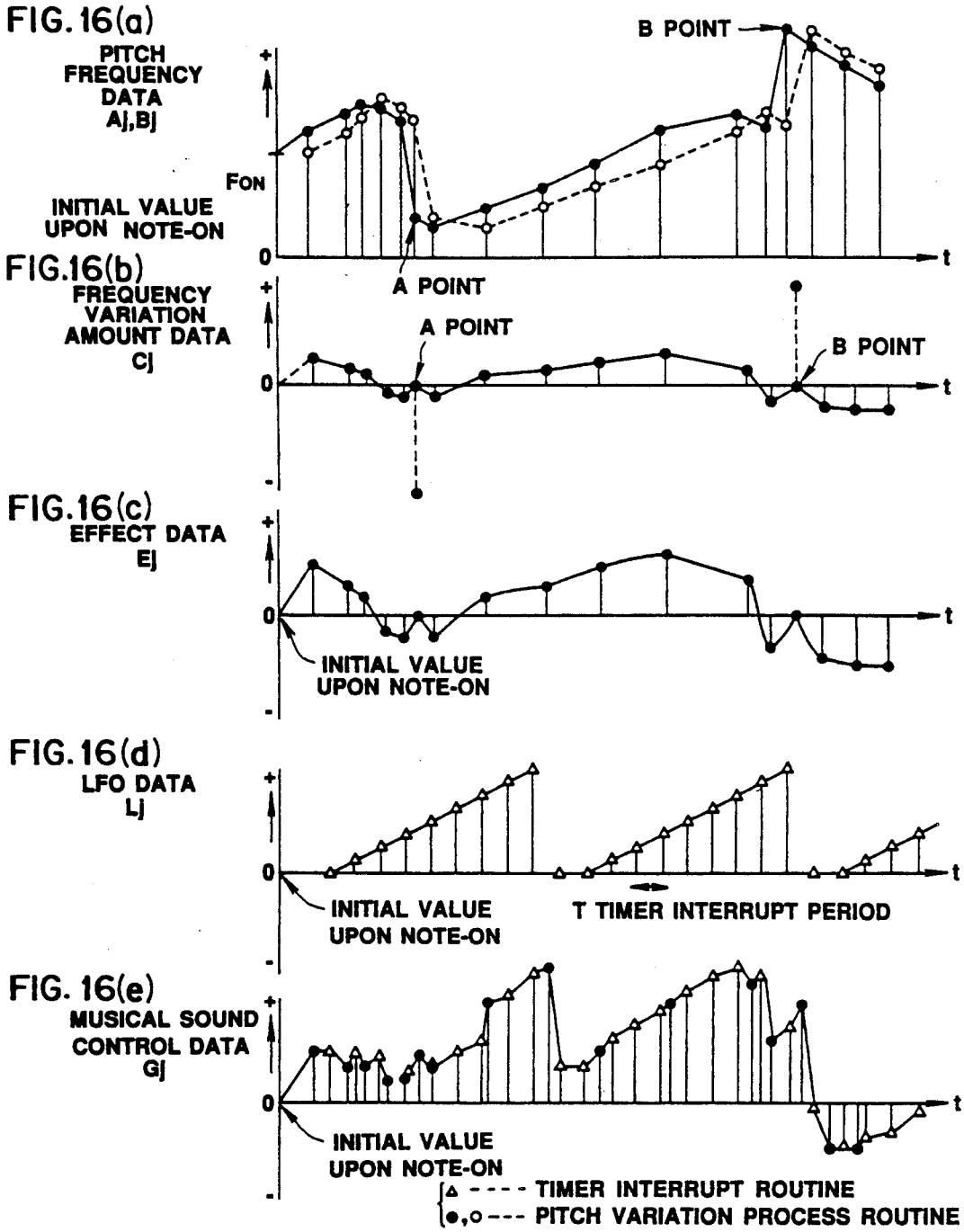

FIGS. 16(*a*) to 16(*e*) correspond to FIGS. 12(*a*) to 12(*e*) relating to the third embodiment.

FIG. 16 differs from FIG. 12 on the following points. At points where a performer performs glissando and trill and where the current frequency data Bj of FIG. 16(*a*) abruptly changes, namely at point A and point B, a judgment of step S102-4 in FIG. 15 becomes YES and Cj is rewritten to an initial value as shown in FIG. 16(*b*). Therefore, the variation of effect data Ej is assumed to be as shown in FIG. 16(*c*). Thus, musical sound control data Gj produced by Ej and Lj, produces Lj without modification, as Ej is 0 at point A and point B of an abrupt frequency variation and becomes Gj smooth after points A and B, as shown in FIG. 16(*e*), thereby providing a desired effective musical sound variation.

Upon performing glissando, trill or hammering as stated above, an abrupt musical sound variation (abnormal sound) accompanied by an abrupt pitch variation is prevented from being produced. Any performing method can provide a desired musical sound variation, thereby enabling the manipulation of an electronic instrument.

6. An explanation of the operation of the sixth embodiment

This embodiment is obtained by combining the second or fourth embodiment with the fifth embodiment. In the sixth embodiment, the frequency variation amount data is arithmetically operated as a difference between the pitch frequency data obtained at a predetermined timing (particularly upon start of sound production) and the value of the current (most recent) pitch frequency data, in addition to operations of the fifth embodiment. Therefore, the relative value of the pitch frequency data is used for a musical sound control parameter, thereby providing a performance effect different from that of the fifth embodiment.

An operation of the sixth embodiment will be explained in detail.

A whole process flow comprising a general flow and an operational flow of an interrupt processing routine is as in FIGS. 2 and 3 of the first embodiment, as in the fifth embodiment. An operational flow of a note-on process and a timer interrupt routine is the same as in FIGS. 9 and 11 relating to the third embodiment, as in the fifth embodiment.

Figure 17:
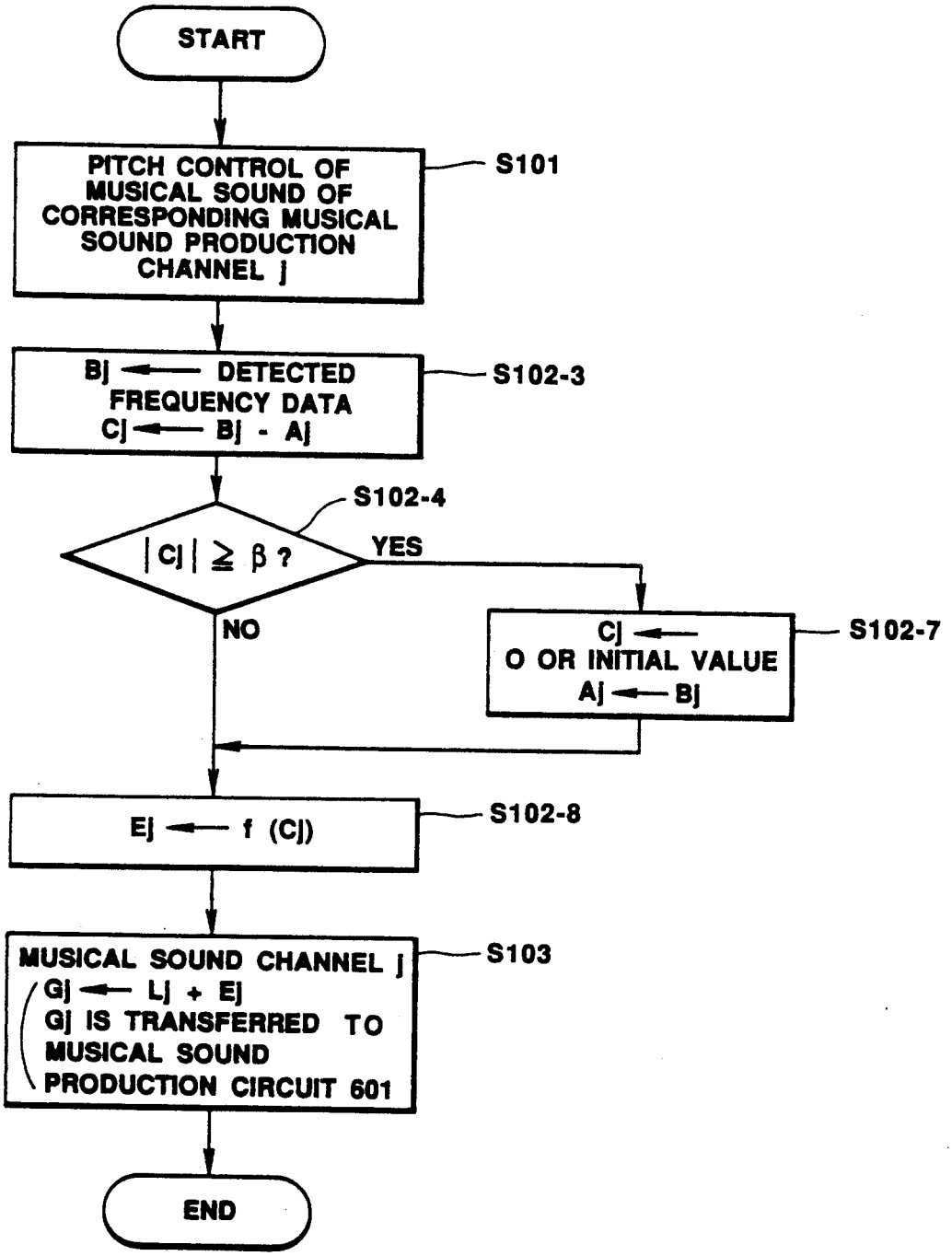

FIG. 17 is an operational flow chart of the pitch variation processing routine relating to the sixth embodiment.

In FIG. 17, steps S101, S103, S102-3 and S102-4 are the same as the steps designated by the same reference numbers in the fifth embodiment shown in FIG. 15, except that steps S102 7 and S102-8 in FIG. 17 replace steps S102-5 and S102-6 in FIG. 15. In steps S102-3 to S102-8, the previous frequency data Aj is set only upon a note-on timing (step S44-2 of FIG. 9) and is not renewed providing the absolute value of the frequency variation amount data $|Cj|$ does not exceed a threshold value of data $\beta$.

When the frequency exceeds the threshold value of data $\beta$ by a judgment at steps S102-4, 0 or an initial value is set at an absolute value of frequency variation amount data $|Cj|$ at step S102-7 and the current (most recent) frequency data Bj is set at the previous frequency data Aj.

As a result, effect data Ej obtained at S102-8 is initialized when the variation of the frequency data becomes large and thereafter is formed by frequency variation amount data Cj based on the current (most recent) frequency data Bj, thereby providing a smooth variation.

As a result of the above process, musical sound control data Gj is obtained by effect data Ej and LFO data Lj at step S103.

Based on effect data Ej arithmetically operated at step S 102-8, a timer interrupt routine of FIG. 11 also operates.

As described above, musical sound control data Gj is formed both at an input timing of LFO data and a timing of a pitch variation, as in the third embodiment.

Variation characteristics of musical control data Gj obtained from the above operation will be explained by referring to FIG. 18.

Figures 18A, 18B, 18C, 18D, 18E:
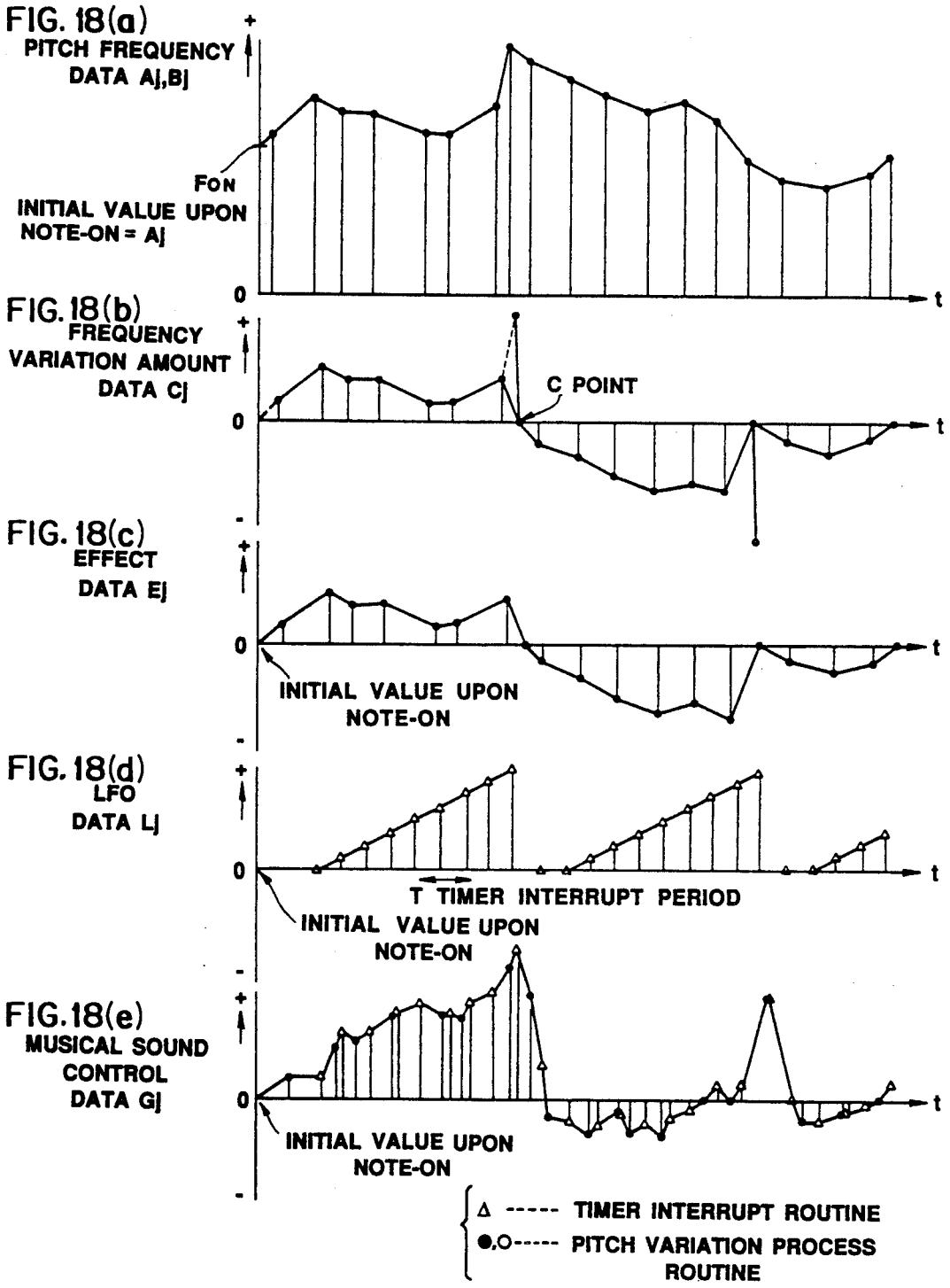

FIGS. 18(*a*) to 18(*e*) correspond to FIGS. 14(*a*) to 14(*e*) relating to the fourth embodiment.

FIGS. 18(*a*) to 18(*e*) differ from FIGS. 14(*a*) to 14(*e*) on the following points. At points A and B, where current frequency variation amount control data Cj exceeds the threshold value data $\beta$, judgment at step S102-4 in FIG. 17 becomes YES, and Cj is rewritten to an initial value as shown in FIG. 18(*c*). And data Aj for frequency comparison is rewritten to new frequency data Bj. Therefore, at a point C, where the current frequency data Bj abruptly changes in FIG. 18(*a*), frequency variation amount data Cj is initialized as shown in FIG. 18(*b*) and the variation of effect data Ej is suppressed as shown in FIG. 18(*c*). Therefore, musical sound control data Gj formed by Ej and Lj becomes smooth data as shown in FIG. 18(*e*) after Ej is once initialized at a point C of an abrupt frequency change point, thereby, providing a desired effective musical sound variation.

At this time the characteristics of FIGS. 18(*c*) and 18(*d*) based on the frequency data variation characteristics of FIG. 18(*a*) are changed by a choking or a tremolo arm operation by a performer and particularly by a change in depth of the operation. This is similar to the second and fourth embodiments and different from the fifth embodiment in the characteristics of musical sound varied in accordance with the variation in operation speed. Therefore, when using such a performance operation, a performer can change the musical sound control data Gj of FIG. 18(*e*) with characteristics different from those of the fifth embodiment, thereby providing a new performance expression.

7. The other modes of the fifth the sixth embodiments

In the above fifth or sixth embodiment, the judgment may be made based on the difference between the current frequency data Bj and the previous frequency data at step S102-4 in FIG. 15 or 17. Cj may be corrected by the value of the current frequency data Bj itself. Cj is corrected by making it 0 or an initial value, but may be corrected by making it the same as the previous value.

8. An explanation of the operation of the seventh embodiment

Next, the seventh embodiment will be explained. In the first to sixth embodiments, characteristics of the musical sound to be produced are controlled, based basically only on the frequency variation data in accordance with the pitch variation. However, in a natural musical instrument such as an acoustic guitar, characteristics of musical sound vary delicately in accordance with the strength of the performance, namely the velocity, thereby enhancing a musical expression.

In the seventh embodiment, both frequency variation data and velocity data are made to form LFO data which controls the musical sound. This enables a performer to vary the characteristics of the musical sound, not only by changing the speed of a choking or tremolo arm operation, but also by changing the strength at which a string is picked.

An operation of the seventh embodiment will be explained in detail. In the seventh embodiment, as in the third embodiment, musical sound variation control based on pitch variation can be conducted not only at the oscillation timing of LFO 5 in FIG. 1 but also when pitch extracting circuit 2 produces a new pitch data.

A whole process flow comprising a general flow and an operational flow of the interrupt processing routine, as in the third embodiment is as shown in FIGS. 2 and 3 relating to the first embodiment. An operation flow of a timer interrupt routine is as shown in FIG. 11 relating to the third embodiment.

Figure 19:
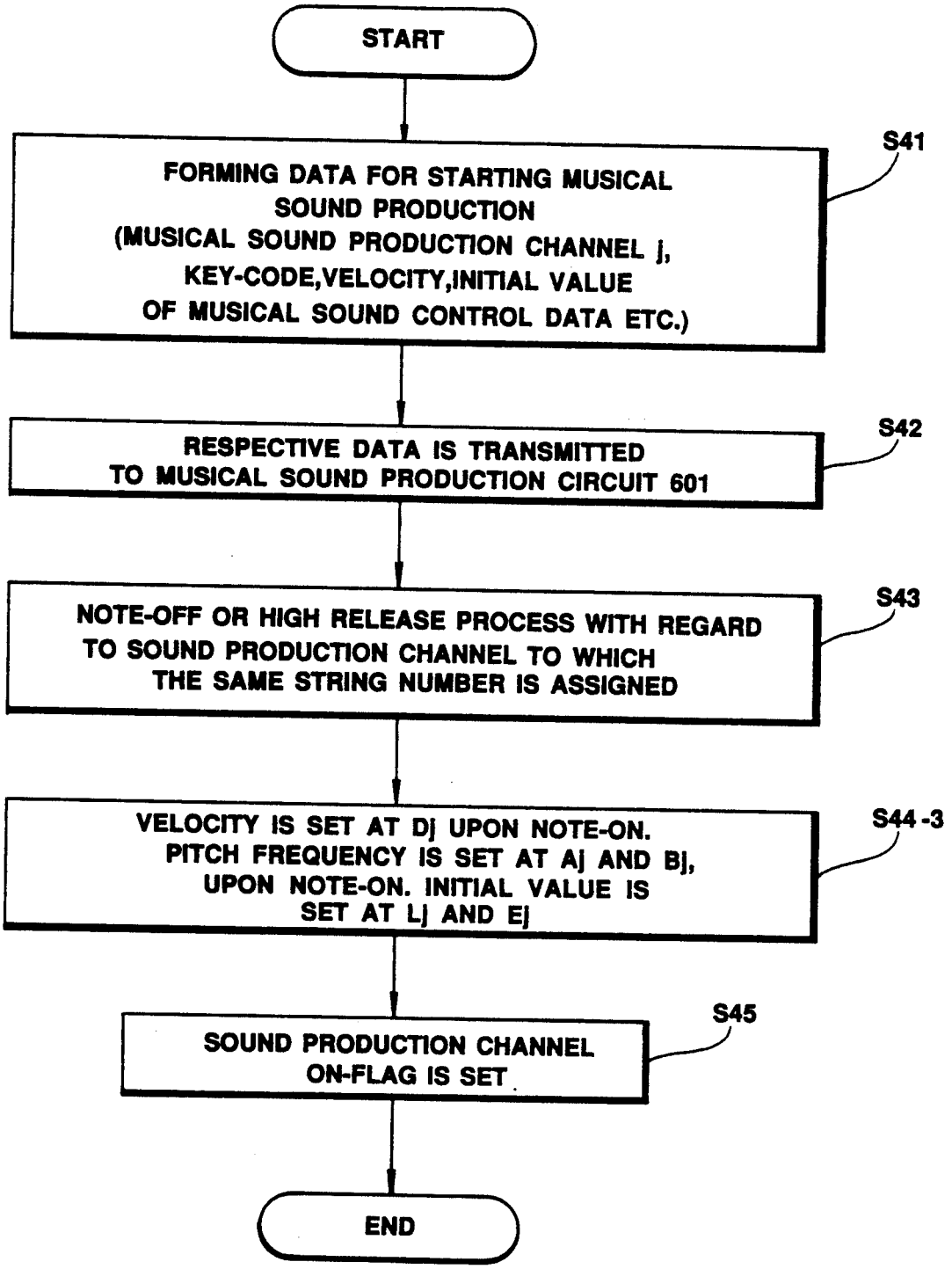

FIG. 19 is an operational flow chart of a note-on process relating to the seventh embodiment. Steps S41 to 43 and S 45 in FIG. 19 are the same as the steps designated by the same reference numbers in FIG. 9 except that step S44-3 in FIG. 19 replace step S44-2 in FIG. 9.

In step S44-3, as in the third embodiment, pitch frequency upon a note-on timing is stored in RAM 302 (FIG. 1) as the previous frequency data Aj and the current (most recent) frequency data Bj corresponding to sound production channel j. Respective initial values of LFO data Lj and effect data Ej (j=1-6) are similarly set in RAM 302. In addition, velocity (data formed at step S41) upon a note-on timing is set as velocity data Dj. A method of utilizing these data will be explained later.

Figure 20:
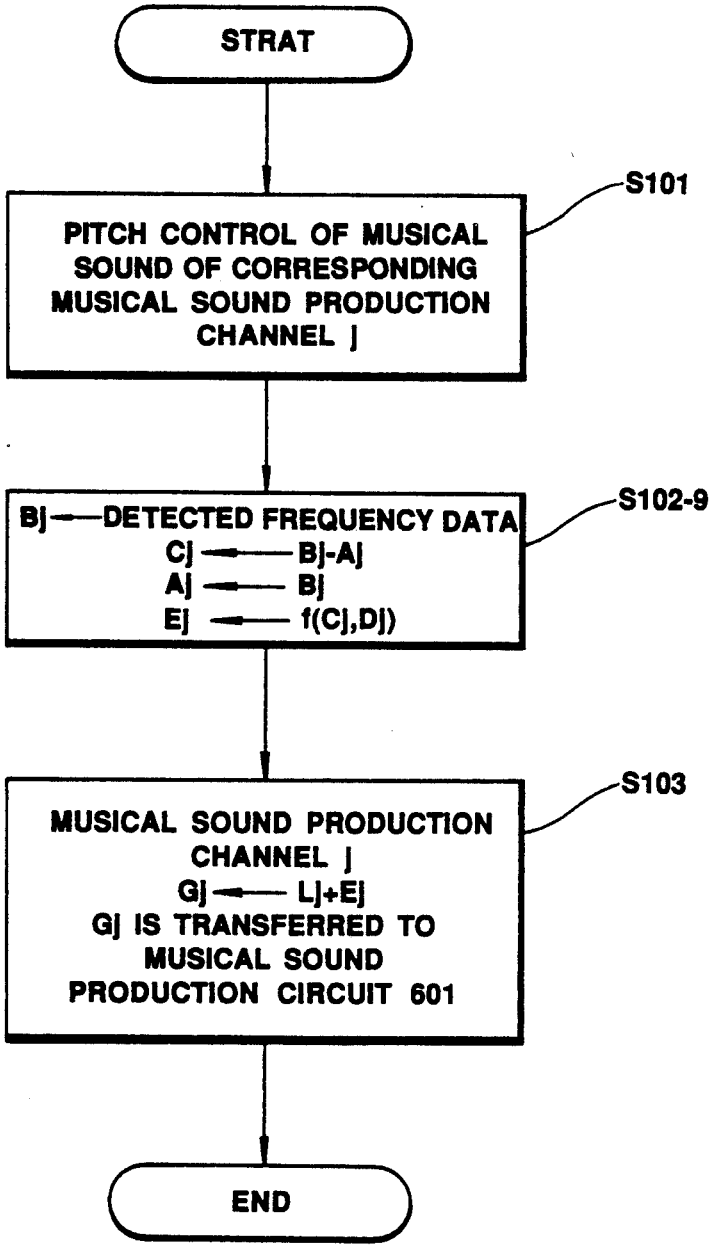

Next, FIG. 20 is an operational flow chart of a pitch variation processing routine relating to the seventh embodiment. As the seventh embodiment includes the processing routine, a musical sound variation control based on pitch variation is conducted both at an oscillation timing of LFO 5 of FIG. 1 and at a timing when pitch extracting circuit 2 produces a new pitch data, as in the third embodiment.

In FIG. 20, steps S101 and S103 are the same as the steps designated by the same reference numbers in FIG. 10, except that step S102-9 in FIG. 20 replaces S102 in FIG. 10.

In this step, the respective processes of setting current (most recent) frequency data Bj, arithmetically operating frequency variation amount data Cj and rewriting the previous frequency data Aj, are the same as those at step S102 in FIG. 10 relating to the third embodiment. However, the method of arithmetically operating effect data Ej differs from that of step S102. Namely, effect data Ej is obtained by an arithmetic operation of converting frequency variation amount data Cj and velocity data Dj by an appropriate conversion function f. Velocity data Dj is set as a velocity upon a note-on timing in step S44-3 during a note-on processing in FIG. 19. Specifically, frequency variation amount data, for example, is converted by an appropriate monotonically increasing function g and the converted result is multiplied by velocity data Dj. Thus, effect data Ej is obtained by an arithmetic operation of $Ej=f(Cj,Dj)=Dj\cdot g(Cj)$. Or velocity data Dj is converted by another appropriate monotonically increasing function h and the result h(Dj) is multiplied by the above recited g(Cj). Thus, it is possible to set as $Ej=f(Cj,Dj)=h(Dj)\cdot g(Cj)$ based on arithmetic operation. Various kinds of arithmetic operation equations can be adopted for Ej. Effect data Ej arithmetically operated as recited above is set in RAM 302 (FIG. 1).

At step S103, effect data Ej obtained from an arithmetic operation of frequency variation amount data Cj and velocity data Dj is added to LFO data Lj, thereby producing musical sound control data Gj. This musical sound control data Gj is transferred to musical sound production circuit 601 (FIG. 1) and is also stored in RAM 302.

Effect data Ej is obtained by an arithmetic operation based on frequency variation amount data Cj as obtained in the above recited manner and musical sound control data Gj is further obtained at step S103. The timer interrupt routine of FIG. 11 is operated based on effect data Ej arithmetically operated in the above step S102-9. As explained above, musical sound control data Gj, as in the third embodiment, is obtained both at an input timing of LFO data and at a timing of a pitch variation, and is controlled based on both the pitch variation and the velocity variation.

Variation characteristics of an actual musical sound control Gj produced in the above processes will be explained hereinafter.

Basically, it operates in a similar manner to that of FIG. 12 relating to the third embodiment. When frequency data variation as shown in FIG. 12(*a*) is input, frequency variation amount data Cj, subjected to an arithmetic operation at step S102-9 of FIG. 20, is obtained at a timing designated by a plot ● in FIG. 12(*b*).

This embodiment differs from the third emobidment in that effect data Ej obtained as a plot ● in FIG. 12(*c*) is arithmetically operated from the frequency variation Cj of FIG. 12(*b*) and velocity data Dj.

Based on the above effect data Ej, musical sound control data Gj is obtained at a timing of a plot ● of FIG. 12(*e*) at step S103 of FIG. 20 and at a timing of a plot (Δ) of FIG. 12(*e*) at step S111 of FIG. 11.

Based on the above musical sound control data Gj, a timbre control parameter (overtone structure ratio, for example) of musical sound production circuit 601 (FIG. 1) is controlled.

As described above, a performer performs a choking or a tremolo arm operation and particularly changes the speed of the operations, thereby enabling musical sound control data Gj to vary discretionally. Velocity data Dj varies simultaneously in accordance with the strength at which a string is picked by a performer, resulting in a variation of effect data Ej and further changing musical sound control data Gj. Accordingly, it becomes possible to delicately control performance expression according to the strength at which a string is picked, thereby, producing a natural and rich musical expression.

9. An explanation of the operation of the eighth embodiment

This embodiment is obtained by combining the above recited second or fourth embodiment with the above seventh embodiment. Namely, in the eighth embodiment, the frequency variation amount data is obtained by an arithmetic operation as a difference between pitch frequency data at a predetermined timing (particularly upon start of sound production) and the current (most recent) value of the pitch frequency data, in addition to the operations of the seventh embodiment. Therefore, the relative value of the pitch frequency data is used as a musical sound control parameter and can provide a performance effect which is different from that of the seventh embodiment.

An operation of the eighth embodiment will be described in detail hereinafter.

A whole process flow comprising a general flow and an operation flow of an interrupt processing routine is as shown in FIGS. 2 and 3 relating to the first embodiment, as is similar to the seventh embodiment. The note-on process and an operational flow of the timer interrupt routine is as shown in FIGS. 19 and 11 relating to the third embodiment, as for the seventh embodiment.

Figure 21:
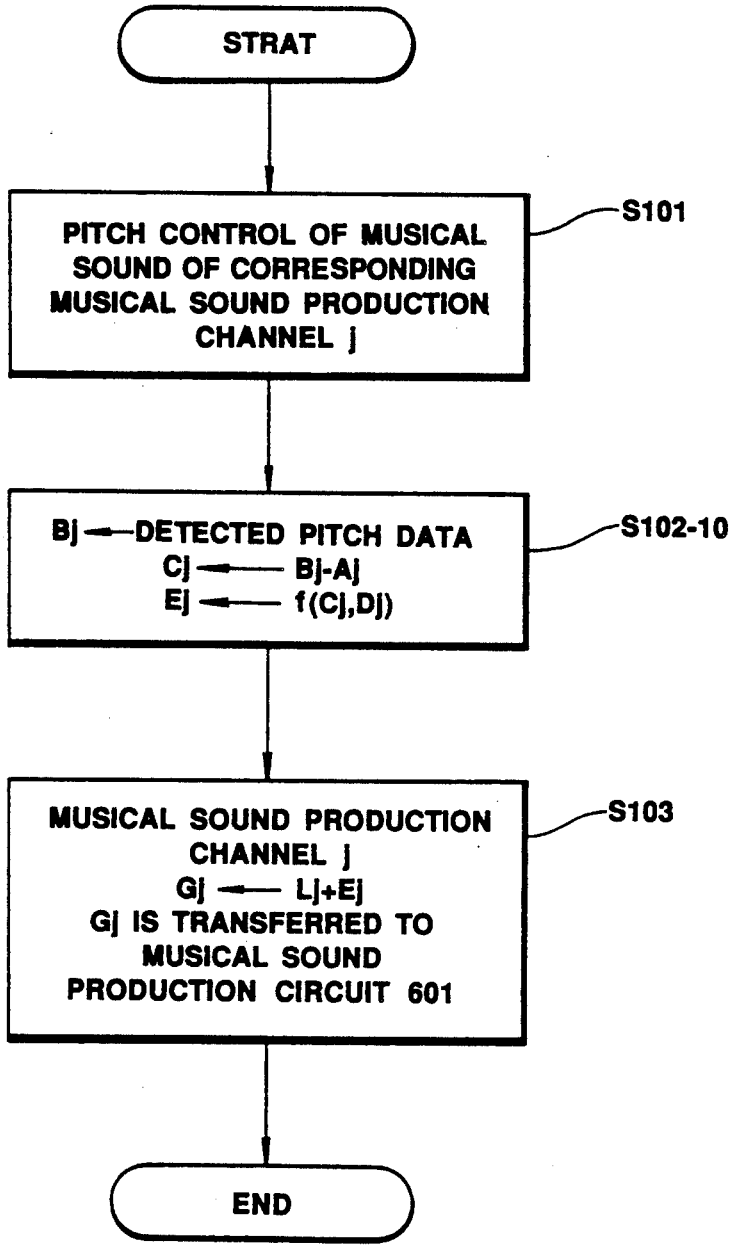

FIG. 21 is an operational flow chart of a pitch variation processing routine relating to the eighth embodiment.

In FIG. 21, steps S101 and S103 are the same as the steps designated by the same reference numbers in FIG. 20, except that step S102-10 in FIG. 21 replaces step S102-9 in FIG. 20. At step S102-10, the previous frequency data Aj is set upon a note-on timing (FIG. 19, S44-3) as in step S53-2 of FIG. 7 relating to the second embodiment. Thereafter the previous frequency data Aj is not renewed. Therefore, frequency variation amount data Cj is arithmetically operated by the current (most recent) frequency data Bj and the previous frequency data Aj set upon a note-on timing.

Effect data Ej is arithmetically operated based on frequency variation amount data Cj obtained as described above, and further at step S103, musical sound control data Gj is obtained.

Based on frequency variation amount data Cj and effect data Ej arithmetically operated at step S102-10, the timer interrupt routine of FIG. 11 is also operated.

As explained above, musical sound control data Gj is, similar to those of the seventh embodiment, produced at an input timing of LFO data and a timing of a pitch variation, and is controlled based on both the pitch variation and velocity variation.

Variation characteristics of actual musical sound control data Gj produced by the above process is explained as follows.

Basically, it operates in a similar manner to the operation of FIG. 14 relating to the fourth embodiment, and when frequency variation data as shown in FIG. 14(*a*) is input, frequency variation amount data Cj arithmetically processed at step S102-10 of FIG. 10 is obtained at a timing designated by plot ● of FIG. 14(*b*). In FIG. 14(*a*), an initial value $F_{ON}$ upon a note-on timing at $t=0$ is Aj.

Effect data Ej obtained as a plot ● of FIG. 14(*c*) is arithmetically operated from frequency variation amount data Cj and velocity data Dj of FIG. 14(*b*), which differs from the fourth embodiment.

Based on effect data Ej, musical sound control data Gj is obtained at a timing represented by a plot ● of FIG. 14(*e*) in step S103 in FIG. 21 and at a timing represented by a plot (Δ) of FIG. 14(*e*) at step S111 in FIG. 11.

Based on musical sound control data Gj, a timbre control parameter (overtone structure ratio for example) of the musical sound production circuit 601 (FIG. 1) is controlled.

Thus, it becomes possible to delicately change the performance and expression according to the strength at which a string is picked as in the seventh embodiment. On the other hand, when a performer performs a choking or tremolo arm operation, the depth of the operation thereby varies the musical sound control data Gj discretionally. This is similar to the second and fourth embodiment and is different from the seventh embodiment in that characteristics of musical sound are changed by the variation in speed of the above operation. Therefore, such an operation can change musical sound control data in accordance with the characteristics different from those of the seventh embodiment, thereby providing new performance expression.

10. Other modes of the seventh and eighth embodiments.

In the seventh or eighth embodiment, any function can be used to convert frequency variation amount data Cj and velocity data Dj to effect data Ej.

Further, in the above two embodiments, effect data Ej is produced by frequency variation amount data Cj and velocity data Dj. In contrast, the first effect data $E_1j$ is made from frequency variation amount data Cj and the second effect data $E_2j$ is made from velocity data Dj, thereby enabling these two blocks of data to control different musical sound characteristics.

11. An explanation of other embodiments

In the first to eighth embodiment, effect data Ej obtained by an arithmetic operation against frequency variation amount data Cj, modulates LFO data Lj and may modulate any kind of other parameters for controlling musical sounds.

In the first to eighth embodiment, an addition of effect data Ej and LFO data Lj provides new musical sound control data Gj but the new musical sound control data Gj may be obtained by any other arithmetic operation or function. This application is applied not only in the case where the controlled parameter is LFO data Lj but also in the case where the controlled parameter is other musical sound control parameters.

Further, in a timer interrupt routine in the second, fourth, sixth or eighth embodiment, a pitch frequency data upon a note-on timing is used as data Aj to arithmetically operate frequency variation amount data Cj. In contrast, a pitch frequency data detected after a predetermined period or a pitch frequency data detected after a predetermined number of detection operations may be used as data Aj.

In contrast, the number of strings of the electronic guitar of FIG. 1 is six, but that invention is not limited to an instrument with six strings. Further, if a pitch frequency can be detected, it can be applied to an electronic musical instrument other than an electronic guitar.

For pitch extracting circuit 2 of FIG. 1, any type of apparatus which can detect a pitch frequency based on a string oscillation or other acoustic oscillation (input waveform) can be used.

What is claimed is:

1. A control apparatus for use in a musical sound production apparatus for controlling characteristics of a musical sound to be produced by a musical sound production apparatus based on an input waveform signal, said control apparatus comprising:

pitch extraction means for extracting pitch data from an input waveform signal;

pitch variation detection means coupled to said pitch extraction means for detecting a variation of said pitch data, including means for calculating pitch variation data which represents a difference between a previously extracted pitch data and currently extracted pitch data; and control means coupled to said pitch variation detecting means for variably controlling selected characteristics including one of timbre and tone volume other than pitch of the musical sound to be produced by said musical sound production apparatus based on said pitch variation data.

2. The control apparatus for use in a musical sound production apparatus according to claim 1, wherein said pitch variation detection means subtracts previously extracted pitch data from currently extracted pitch data selected from among the pitch data sequentially extracted from said pitch extraction means, thereby detecting said pitch variation data.

3. The control apparatus for use in a musical sound production apparatus according to claim 1, wherein said pitch variation detection means subtracts pitch data extracted at a predetermined timing from pitch data extracted at the most recent timing by said pitch extraction means, thereby detecting said pitch variation data.

4. The control apparatus for use in a musical sound production apparatus according to claim 3, wherein said pitch variation detection means subtracts pitch data extracted upon a start of input of said input waveform signal from pitch data extracted at the most recent timing by said pitch extraction means, thereby detecting said pitch variation data.

5. The control apparatus for use in a musical sound production apparatus according to claim 3, wherein said pitch variation detection means subtracts pitch data extracted a predetermined period from the start of input of said input waveform signal, from pitch data extracted at the most recent timing by said pitch extraction means, thereby detecting said pitch variation data.

6. The control apparatus for use in a musical sound production apparatus according to claim 3, wherein said pitch variation detection means subtracts pitch data extracted after a predetermined number of pitch data are extracted after a start of input of said input waveform signal, from pitch data extracted at the most recent timing by said pitch extraction means, thereby detecting said pitch variation data.

7. A control apparatus for using a musical sound production apparatus of an electronic guitar for controlling characteristics of a musical sound to be produced, said control apparatus comprising:

pick-up means for detecting a string oscillation caused by a string being plucked by a performer as a string oscillation waveform signal;

pitch extraction means coupled to said pickup means for extracting pitch data from said string oscillation waveform signal;

pitch variation detection means coupled to said pitch extraction means for detecting said pitch data variation, including means for calculating pitch variation data which represents a difference between a previously extracted pitch data and currently extracted pitch data; and control means coupled to said pitch variation detection means for variably controlling selected characteristics including one of timbre and tone volume other than pitch of the musical sound to be produced by said musical sound production apparatus based on said pitch variation data.

8. A control apparatus for use in a musical sound production apparatus, for controlling the characteristics of a musical sound to be produced by a musical sound production apparatus based on an input waveform signal, said control apparatus comprising:

pitch extraction means for extracting pitch data from the input waveform signal;

pitch variation detection means coupled to said pitch extraction means for detecting a variation of said pitch data, including means for calculating pitch variation data which represents a difference between a previously extracted pitch data and currently extracted pitch data;

periodic signal production means for producing a periodic signal; and control means coupled to said pitch variation detection means and to said periodic signal production means for variably controlling selected characteristics including one of timbre and tone volume other than pitch of a musical sound to be produced by said musical sound production apparatus, in accordance with a control signal formed based on said pitch variation data and said periodic signal.

9. The control apparatus for use in a musical sound production apparatus according to claim 8, wherein said control means performs a variable control operation for controlling characteristics of the musical sound both when the pitch data is extracted 10. The control apparatus for use in a musical sound production apparatus according to claim 9, wherein said control means converts said pitch variation data to a modified pitch variation data according to a predetermined conversion function, and adds the modified pitch variation data to said periodic signal to provide an added value which variably controls the characteristics of the musical sound produced by said musical sound production apparatus.

11. The control apparatus for use in a musical sound production apparatus according to claim 10, wherein said control means enables said added value to modulate the amplitude of the musical sound to be produced by said musical sound production apparatus, thereby imparting tremolo effect.

12. The control apparatus for use in a musical sound production apparatus according to claim 10, wherein said control means enables said added value to modulate the frequency of a musical sound to be produced by said musical sound production apparatus, thereby providing a vibrato effect.

13. The control apparatus for use in a musical sound production apparatus according to claim 9, wherein said control means performs said variable control operation by using the most recent periodic signal produced by said periodic signal production means when said variable control operation for controlling the characteristics of the musical sound is performed at the time at which pitch data are extracted from said pitch extraction means; and said control means performs said variable control operation by using the most recent pitch data extracted from said pitch extraction means when said variable control operation for controlling the characteristics of the musical sound is performed at the time at which the periodic signal is produced from said periodic signal production means.

14. The control apparatus for use in a musical sound production apparatus according to claim 9, wherein said pitch extraction means outputs a first interrupt signal to said control means every time pitch data is extracted from the input waveform signal;

said periodic signal production means outputs a second interrupt signal to said control means every time a periodic signal is produced; and said control means performs the variable control operation to control the characteristics of the musical sound when said first and second interrupt signal is input.

15. A control apparatus for use in a musical sound production apparatus for controlling characteristics of a musical sound to be produced by a musical sound production apparatus based on an input waveform signal, said control apparatus comprising:

pitch extraction means for extracting pitch data from the input waveform signal, and;

pitch variation detection means coupled to said pitch extraction means for detecting a variation in pitch data, including means for calculating pitch variation data which represents a difference between a previously extracted pitch data and currently extracted pitch data;

pitch variation data correcting means for correcting said pitch variation data obtained by said pitch variation detection means; and control means coupled to said pitch variation data correcting means for variably controlling characteristics including one of timbre and tone volume other than pitch of the musical sound to be produced by the musical sound production apparatus based on corrected pitch variation data.

16. The control apparatus for use in a musical sound production apparatus according to claim 15, wherein said pitch variation data correcting means corrects the pitch variation data in accordance with a magnitude of a pitch variation width based on said pitch variation data.

17. The control apparatus for use in a musical sound production apparatus according to claim 16, wherein said pitch variation data correcting means corrects said pitch variation data to have a variation width of 0 when the magnitude of pitch variation width based on said pitch variation data exceeds a predetermined value.

18. The control apparatus for use in a musical sound production apparatus according to claim 16, wherein said pitch variation data correcting means corrects said pitch variation data to have a predetermined variation width, when the magnitude of pitch variation width based on said pitch variation data exceeds a predetermined value.

19. The control apparatus for use in a musical sound production apparatus according to claim 16, wherein said pitch variation data correcting means corrects said pitch variation data to have the same pitch variation width as the pitch variation data detected by said pitch variation detecting means at a previous timing, when the magnitude of pitch variation width based on said pitch variation data exceeds a predetermined value.

20. The control apparatus for use in a musical sound production apparatus according to claim 15, wherein said pitch variation data correcting means corrects said pitch variation data in accordance with the magnitude of a pitch based on said pitch data.

21. A control apparatus for use in a musical sound production apparatus for controlling characteristics of a musical sound to be produced by a musical sound production apparatus based on an input waveform signal, said control apparatus comprising:

pitch extraction means for extracting pitch data from the input waveform signal;

pitch variation detecting means coupled to said pitch extraction means for detecting a variation of said pitch data, including means for calculating the pitch variation data which represents a difference between a previously extracted pitch data and currently extracted pitch data;

velocity extracting means for extracting velocity data from said input waveform signal; and control means coupled to said pitch variation detecting means and to said velocity extracting means for variably controlling a selected characteristic including one of timbre and tone volume other than pitch of the musical sound to be produced by the musical sound production apparatus based on said pitch variation data and velocity data.

22. A control apparatus for use in a musical sound production apparatus for controlling a characteristics of a musical sound to be produced by a musical sound production apparatus, based on an input waveform signal, said control apparatus comprising:

pitch extraction means for extracting pitch data from the input waveform signal;

pitch variation detecting means coupled to said pitch extraction means for detecting a variation of said pitch data, including means for calculating pitch variation data which represents a difference between a previously extracted pitch data and currently extracted pitch data;

velocity extracting means for extracting velocity data from said input waveform signal;

periodic signal production means for producing a periodic signal; and control means coupled to said pitch variation detecting means, to said velocity extracting means and to said periodic signal production means for variably controlling selected characteristics including one of timbre and tone volume other than pitch of a musical sound produced by said musical sound production apparatus based on said pitch variation data, said velocity data, and said periodic signal.

23. The control apparatus for use in a musical sound production apparatus according to claim 22, wherein said control means converts said pitch variation data by a predetermined conversion function to provide a converted value, the converted value is multiplied by the value determined by said velocity data to provide a multiplied value, the multiplied value is added to said periodic signal to provide an added value, and the added value is used to control the characteristics of the musical sound to be produced by said musical sound production apparatus.

24. The control apparatus for use in a musical sound production apparatus according to claim 22, wherein said control means converts said pitch variation data by a first predetermined conversion function to provide a first converted value and converts said velocity data by a second predetermined conversion function to provide a second converted value, said both first and second converted values are multiplied to provide a multiplied value, the multiplied value is added to the said periodic signal to provide an added value, and characteristics of the musical sound produced by said musical sound production apparatus are variably controlled by said added value.

* * * * *

UNITED STATES PATENT AND TRADEMARK OFFICE

CERTIFICATE OF CORRECTION

PATENT NO. : 5,001,960

DATED : March 26, 1991

INVENTOR(S) : H. KATOU

It is certified that error appears in the above-identified patent and that said Letters Patent is hereby corrected as shown below:

Title page, item [54], and col. 1, lines 1-3, should read:

--APPARATUS FOR CONTROLLING REPRODUCTION OF A MUSICAL SOUND BASED ON PITCH VARIATION OF AN INPUT WAVEEFORM SIGNAL--.

Column 27, line 31 (Claim 9), after "extracted", insert --from said pitch extraction means and when the periodic signal is produced by said periodic signal production means.--

Column 29, line 26 (Claim 22), change "characteristics" to read --characteristic--.

Signed and Sealed this

Fourth Day of May, 1993

*Attest:*

*Attesting Officer*

Michael K. Kirk

MICHAEL K. KIRK

*Acting Commissioner of Patents and Trademarks*